US006518006B2

(12) United States Patent
Sakai et al.

(10) Patent No.: US 6,518,006 B2
(45) Date of Patent: Feb. 11, 2003

(54) SILVER HALIDE COLOR PHOTOGRAPHIC PHOTOSENSITIVE MATERIAL

(75) Inventors: Hidekazu Sakai, Kanagawa (JP); Yasuhiro Shimada, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/802,984

(22) Filed: Mar. 12, 2001

(65) Prior Publication Data

US 2002/0048733 A1 Apr. 25, 2002

(30) Foreign Application Priority Data

Mar. 31, 2000 (JP) ..... 2000-099231

(51) Int. Cl.[7] ..... G03C 7/36; G03C 7/388; G03C 7/22; G03C 1/83

(52) U.S. Cl. ..... 430/507; 430/505; 430/517; 430/522; 430/556; 430/557

(58) Field of Search ..... 430/557, 556, 430/507, 522, 517, 505

(56) References Cited

U.S. PATENT DOCUMENTS

| | | | | | |
|---|---|---|---|---|---|
| 4,078,933 | A | | 3/1978 | Sugiyama et al. | 430/522 |
| 5,213,958 | A | * | 5/1993 | Motoki et al. | 430/557 |
| 5,374,507 | A | * | 12/1994 | Yoshioka | 430/557 |
| 5,609,999 | A | * | 3/1997 | Aida et al. | 430/522 |
| 5,674,667 | A | * | 10/1997 | Clark et al. | 430/557 |
| 5,744,292 | A | * | 4/1998 | Yoneyama | 430/522 |
| 6,057,087 | A | * | 5/2000 | Welter et al. | 430/557 |

FOREIGN PATENT DOCUMENTS

| | | |
|---|---|---|
| EP | 0953871 | 11/1999 |
| EP | 0953873 | 11/1999 |
| EP | 0953874 | 11/1999 |
| JP | A2282244 | 11/1990 |

* cited by examiner

*Primary Examiner*—Richard L. Schilling
(74) *Attorney, Agent, or Firm*—Birch, Stewart, Kolasch & Birch, LLP

(57) ABSTRACT

The present invention provides a silver halide color photographic photosensitive material having superior image sharpness and film strength. Disclosed is a silver halide color photographic photosensitive material in which a yellow-developing photosensitive silver halide emulsion layer on a support contains at least one dye-forming coupler represented by the following general formula (Y-1), and at least one layer of the non-photosensitive hydrophilic colloid layers on the support contains a dispersion of solid particles of a dye represented by the following general formula [I]. In the general formula (Y-1), Y represents a nitrogen-containing heterocycle; Z represents a substituted aryl group; X represents a hydrogen atom, or a group that leaves by the reaction with an oxidized form of a developing solution. In the general formula [I], D represents a residue of a compound having a chromophoric group; X represents a dissociative hydrogen atom or a group having a dissociative hydrogen atom.

General formula (Y-1)

General formula (I)

D-(X)$_y$

32 Claims, No Drawings

SILVER HALIDE COLOR PHOTOGRAPHIC PHOTOSENSITIVE MATERIAL

BACKGROUND OF THE INVENTION

1. Field of the Invention

The present invention relates to a silver halide color photographic photosensitive material having improved color reproducibility and processing stability and more particularly relates to a silver halide color photographic photosensitive material that has these properties and is used for cinema.

2. Description of the Related Art

There is always a need for raising the image quality of a silver halide color photographic photosensitive material that is used for viewing, recording, and preserving images, and therefore much research has been carried out. Examples of the method of raising the image quality of a silver halide color photographic photosensitive material include the following methods.

(1) Enhancement of image sharpness by such means as the use of an irradiation-preventing dye, reduction of the thickness of a hydrophilic colloid layer coated on a support, and formation of a colored layer for the prevention of halation;

(2) Improvement of granularity by the reduction of the sizes of photosensitive silver halide particles or by controlling the shape of dye clouds to be formed;

(3) Enhancement of color reproducibility by the employment of a dye-forming coupler capable of providing excellent spectral absorption characteristics of the coloring dye to be obtained;

(4) Prevention of unnecessary coloration in processed photosensitive materials by a design in which coloring materials such as dyes, sensitizing dyes, and the like are easily decolorized in processing; and (5) Prevention of discoloration and fading by such means as the use of a dye-forming coupler providing a coloring dye having excellent colorfastness and the use of a compound capable of raising the colorfastness of the dye.

Among the properties described above, image sharpness, together with granularity, are important properties in a silver halide color photographic photosensitive material, which may be enlarged when it is viewed or when it is transferred to a material for viewing, or in a silver halide color photographic photosensitive material which needs to be enlarged in order to be viewed, such as a print material for cinema. Further, in images containing character information and illustrations such as those seen in images for use in commercials, the image sharpness of the material displaying such character information and illustrations determines the impression of the entire images. Accordingly, the enhancement of image sharpness is very important to the enhancement of image qualities.

As stated above, the prevention of halation and irradiation is effective as a means of enhancing the image sharpness. As a means of preventing halation and irradiation, the coloring of the hydrophilic colloid layer with a water-soluble dye has been employed. Examples of such dyes include oxonol dyes described in U.S. Pat. No. 4,078,933 and other dyes such as azo dyes, anthraquinone dyes, allylidene dyes, styryl dyes, triarylmethane dyes, merocyanine dyes, and cyanine dyes. When these dyes are coated on a photosensitive material, these dyes are diffused into the entire layer of the photosensitive material, and therefore these dyes are effective in the prevention of irradiation. However, for the prevention of halation, by taking into account the amount of the dye that will be diffused into other layers, a large amount of the dye needs to be added. Such a large amount of the dye will easily bring about photographic problems such as the sensitivity reduction due to the absorption of the dye thus added and the increase of the coloring of the white background due to the residual color of the dye. Accordingly, the formation of a non-diffusive colored layer is necessary for the effective prevention of halation.

Examples hitherto known as the methods of forming a non-diffusive colored layer are a method in which colloidal silver is incorporated in a specific non-photosensitive hydrophilic colloid layer and a method in which a support having a hydrophilic resin layer having fine carbon black particles dispersed therein is used. However, in principle the former cannot be used in a system in which information is recorded by means of the silver formed by development (e.g., a black-and-white photographic photosensitive material or a print material for cinema having sound tracks). On the other hand, the latter needs the removal of the colored layer at the time of image formation and thus increases the number of the steps required for the development processing. This presents a problem that the latter method contradicts the current trend of the simplification of the development processing.

As other methods free from the problems described above, there have been proposed a method in which the hydrophilic colloid layer is selectively colored by use of a polymeric mordant and a method in which a dispersion of solid particles of a dye is used.

However, these methods were also associated with a problem that, when a dye in an amount necessary for the enhancement of image sharpness was added, the reduction in the leaching rate of the dye at the time of development could not be avoided. Therefore, it was difficult to achieve the two properties of images, i.e., image sharpness and prevention of the coloring of the white background, at the same time. Because of this, there has been a search for a dye, which tends to remain in as a dispersion of solid particles in a hydrophilic colloid layer and tends to be easily leached out or decolorized at the time of processing. In this regard, dyes such as those described in Japanese Patent Application Laid-Open (JP-A) No. 2-282244 have been proposed.

On the other hand, the improvement of color reproducibility is also an effective means of raising the image quality of a silver halide color photographic photosensitive material. In a silver halide color photographic photosensitive material, it is well known that a color developing agent based on aromatic primary amine, being oxidized by the silver halide exposed to light and thereafter acting as an oxidizing agent, reacts with a coupler to thereby produce a dye such as indophenol, indoaniline, indamine, azomethine, phenoxazine, or phenazine, and an image is formed. In this photographic process, a subtractive process is employed and color images are formed by yellow, magenta, and cyan dyes. Also in this field, continuous efforts have been made to develop a coupler capable of forming a dye having a higher chromatic level in order to raise the color reproducibility.

Among these couplers, a pivaloylacetanilide-type coupler or a benzoylacetanilide-type coupler has been mostly used for the formation of yellow images. The former provides a dye having a desirable absorption as a yellow dye, but a large amount of the coupler is required in order to obtain a necessary density because the molecular absorption coefficient of the coloring dye is low. The latter provides a dye having a fairly long spectral absorption wavelength as a yellow dye and therefore the latter is inferior to the former in terms of color reproducibility, although the necessary density can be achieved with a relatively small amount of the latter coupler because the molecular absorption coefficient of the dye obtained is high. Therefore a need exists for putting a coupler, which has the advantages of these two couplers, to practical use.

Meanwhile, from a viewpoint other than that of raising image qualities, research for simplifying the handling have also been conducted. Typical of this research is research for the simplification of the development processing. As to the speeding up of the development processing, although various methods have been proposed which approach this from the photosensitive material side, the main research can be summarized into the following two:

(1) Speeding up the development

(2) Speeding up the removal of unnecessary components.

Typical examples of the former is the development of a silver halide emulsion having a higher proportion of silver chloride and the development of a coupler having a higher activity. Regarding the latter, the bleach-fixing speed has been increased and the development of a dye that is easily decolorized has been made as stated previously.

As another approach, the improvement of processing methods has also been studied. A typical example is increasing the transfer speed of photosensitive materials in a development processing apparatus. According to this method, although the time required for the processing of the first photosensitive material does not change, the number of photosensitive materials to be processed in a unit of time increases for the second photosensitive material and those thereafter. That is, the efficiency at the time when a large amount of the photosensitive material is processed, is raised. In addition, when this method is applied to a roll film, the length of the photosensitive material to be processed in a unit of time is increased. Because of this, this method is used as a standard method for raising the efficiency in fields where a long roll film, such as a photosensitive material for cinema is processed. In such processing, the photosensitive material is exposed to a very large physical stress in comparison with the photosensitive material in ordinary processing. Accordingly, the enhancement of the film strength at the time of processing is pointed out as an important property, in addition to the above-described two items when speeding up the development processing is approached from the photosensitive material side.

The present inventors were conducting the research on a yellow coupler from the viewpoint of enhancing color reproducibility. In the process of the research, they found that an acetanilide-type yellow coupler having a carbonyl group linked directly to a nitrogen-containing heterocycle has the above-mentioned properties which are ideal for a yellow coupler. They found that, by combining this yellow coupler with an antihalation layer composed of a dispersion of solid particles of a specific dye, and also by the thickness of the layer being reduced due to the high molecular absorption coefficient of the dye to be obtained from the coupler, it becomes possible to prepare a silver halide color photographic photosensitive material having excellent color reproducibility and white background free from coloration.

However, it was found that the film strength of the silver halide color photographic photosensitive material prepared according to the technique described above was reduced.

Particularly, the film strength in water which is an important property at the time of the development processing was reduced.

SUMMARY OF THE INVENTION

It is accordingly the task of the present invention to solve the problems in the prior art and to achieve the following objects.

That is, the first object of the present invention is to provide a silver halide color photographic photosensitive material having a good image quality, a silver halide color photographic photosensitive material for cinema in particular.

The second object of the present invention is to provide a silver halide color photographic photosensitive material having a higher color reproducibility and excellent image sharpness, in particular, a silver halide color photographic photosensitive material for cinema.

The third object of the present invention is to provide a silver halide color photographic photosensitive material, which has sufficient density of developed color, color reproducibility, and excellent image sharpness and which has improved physical strength of film, in particular, a silver halide color photographic photosensitive material for cinema.

The fourth object of the present invention is to provide a silver halide color photographic photosensitive material, which matches high-efficiency processing as a result of improvement of the film strength thereof particularly the film strength in water, in particular, a silver halide color photographic photosensitive material for cinema.

The first aspect as a means for solving the problems described above is as follows.

That is, a silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein the yellow-developing photosensitive silver halide emulsion layer contains at least one dye-forming coupler represented by the following general formula (Y-1), the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [I]:

General formula (Y-1)

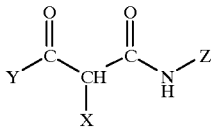

wherein Y represents a nitrogen-containing heterocycle; z represents a substituted aryl group; X represents a hydrogen atom, or a group that leaves by the reaction with an oxidized form of a developing solution:

General formula (I)

$$D\text{-}(X)_y$$

wherein D represents a residue of a compound having a chromophoric group; X represents a dissociative hydrogen atom or a group having a dissociative hydrogen atom; and y is an integer of 1 to 7.

The second aspect as a means for solving the problems described above is as follows. That is, a silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein the yellow-developing photosensitive silver halide emulsion layer contains at least one dye-forming coupler represented by the following general formula (Y-1), the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [II]:

General formula (Y-1)

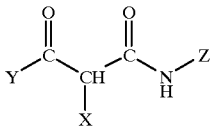

wherein Y represents a nitrogen-containing heterocycle; Z represents a substituted aryl group; X represents a hydrogen atom, or a group that leaves by the reaction with an oxidized form of a developing solution:

General formula (II)

$$A^1{=}L^1{-}(L^2{=}L^3)_m{-}Q$$

wherein $A^1$ represents an acidic nucleus, Q represents an aryl group or a heterocyclic group; $L^1$, $L^2$, and $L^3$ each represents a methine group; and m represents 0, 1, or 2, with the proviso that the dye represented by the general formula [II] described above has in the molecule thereof 1 to 7 carboxyl groups.

The third aspect as a means for solving the problems above described is as follows. That is, a silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein the yellow-developing photosensitive silver halide emulsion layer contains at least one dye-forming coupler represented by the following general formula (Y-1), the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [III].

General formula (Y-1)

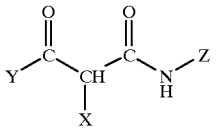

wherein Y represents a nitrogen-containing heterocycle; z represents a substituted aryl group; X represents a hydrogen atom, or a group that leaves by the reaction with an oxidized form of a developing solution.

General formula (III)

$$A^1{=}L^1{-}(L^2{=}L^3)_n{-}A^2$$

wherein $A^1$ and $A^2$ each represents an acidic nucleus; $L^1$, $L^2$, and $L^3$ each represents a methine group; and n represents 1, or 2, with the proviso that the dye represented by the general formula [III] described above has in the molecule thereof 1 to 7 carboxyl groups.

DESCRIPTION OF PREFERRED EMBODIMENTS

The details of the silver halide color photographic photosensitive material of the present invention are explained below.

First, the dye-forming coupler represented by the following general formula (Y-1) is described.

In the general formula (Y-1), Y represents a nitrogen-containing heterocyclic group. The heterocyclic group is a nitrogen-containing heterocyclic group which has at least one nitrogen atom as a constituent of the ring and which comprises preferably a nitrogen atom, an oxygen atom, a sulfur atom, and a carbon atom as a constituent of the ring (i.e., an atom constituting the ring itself and therefore a hydrogen atom or a substituent, if any, is not considered a constituent of the ring).

The nitrogen-containing heterocyclic group may have a substituent, and may be fused with a benzene ring, an aliphatic ring, a heterocycle, or the like. The number of ring members is preferably 3 to 8, more preferably 5 to 6, and particularly preferably 5. If the heterocycle is fused with a benzene ring, an aliphatic ring, a heterocycle, or the like, the portion which is joined with the heterocycle is not counted as a ring member.

The ring portion of the nitrogen-containing heterocyclic group may be a saturated ring or an unsaturated ring. In the case where the ring portion of the nitrogen-containing heterocyclic group is an unsaturated ring, the ring portion may be an aromatic ring. The ring portion is preferably a saturated ring or an aromatic ring (heterocyclo-aromatic ring) and more preferably an aromatic ring (heterocyclo-aromatic ring). Among these rings, a 5-membered aromatic ring (heterocyclo-aromatic ring) is particularly preferable.

The number of the carbon atoms of the nitrogen-containing heterocycle described above is preferably 0 to 60, more preferably 1 to 50, and particularly preferable is 3 to 40. The constituent atoms are selected preferably from a nitrogen atom and a carbon atom. In that case, the number of the nitrogen atom is preferably 1 to 2.

Examples of the nitrogen-containing heterocyclic group include a 1-pyrrolidinyl group, a 1-pyrrolyl group, a 2-pyrrolyl group, a pyrrolyl group, an imidazolyl group, a 1-imidazolyl group, a pyrazolyl group, a 3-, 4-, or 5-pyrazolyl group, an indolizinyl group, a benzimidazolyl group, an indolinyl group, an indolyl group, a 2-indolyl group, a 3-indolyl group, and so on.

Among these groups, a 1-pyrrolyl group, a 2-pyrrolyl group, a pyrrolyl group, a benzimidazolyl group, a 1-H-indazolyl group, an indolinyl group, an indolyl group, a 2-indolyl group, and a 3-indolyl group are preferable; a 2-pyrrolyl group, a pyrrolyl group, an indolinyl group, a 2-indolyl group, and a 3-indolyl group are more preferable; a pyrrolyl group and a 3-indolyl group are further preferable; and a 3-indolyl group is particularly preferable.

Specific examples of the substituents that may be linked to the nitrogen-containing heterocyclic group described above include a halogen atom (e.g., a chlorine, bromine, or fluorine atom), an alkyl group (an alkyl group having 1 to 60 carbon atoms, e.g., a methyl, ethyl, propyl, iso-butyl, t-butyl, t-octyl, 1-ethylhexyl, nonyl, cyclohexyl, undecyl, pentadecyl, n-hexadecyl, or 3-decanamidepropyl group), an alkenyl group (an alkenyl group having 2 to 60 carbon atoms, e.g., a vinyl, allyl, or oleyl group), a cycloalkyl group (a cycloalkyl group having 5 to 60 carbon atoms, e.g., a cyclopentyl, cyclohexyl, 4-t-butylcyclohexyl, 1-indanyl, or cyclododecyl group), an aryl group (an aryl group having 6 to 60 carbon atoms, e.g., a phenyl, p-tolyl, or naphthyl group), an acylamino group (an acylamino group having 2 to 60 carbon atoms, e.g., an acetylamino, n-butaneamido, octanoylamino, 2-hexyldecaneamido, 2-(2',4'-di-t-amylphenoxy)butaneamido, benzoylamino, or nicotineamido group), a sulfonamide group (a sulfonamide group having 1 to 60 carbon atom, e.g., a methanesulfonamide, octanesulfonamide, or benzenesulfoneamide group), a ureido group (a ureido group having 2 to 60 carbon atoms, e.g., a decylaminocarbonylamino or di-n-octylaminocarbonylamino group)

a urethane group (a urethane group having 2 to 60 carbon atoms, e.g., a dodecyloxycarbonylamino, phenoxycarbonylamino, or 2-ethylhexyloxycarbonylamino group), an alkoxy group (an alkoxy group having 1 to 60 carbon atoms, e.g., a methoxy, ethoxy, butoxy, n-octyloxy, hexadecyloxy, or methoxyethoxy group), an aryloxy group (an aryloxy group having 6 to 60 carbon atoms, e.g., a phenoxy, 2,4-di-t-amylphenoxy, 4-t-octylphenoxy, or naphthoxy group), an alkylthio groups (an alkylthio group having 1 to 60 carbon atoms, e.g., a methylthio, ethylthio, butylthio, or hexadecylthio group), an arylthio group (an arylthio group having 6 to 60 carbon atoms, e.g., a phenylthio or 4-dodecyloxyphenylthio group), an acyl group (an acyl group having 1 to 60 carbon atoms, e.g., an acetyl, benzoyl, butanoyl, or dodecanoyl group), a sulfonyl group (a sulfonyl group having 1 to 60 carbon atoms, e.g., a methanesulfonyl, butanesulfonyl, or toluenesulfonyl group), a cyano group, a carbamoyl group (a carbamoyl group having 1 to 60 carbon atoms, e.g., an N,N-dicyclohexylcarbamoyl group), a sulfamoyl group (a sulfamoyl group having 0 to 60 carbon atoms, e.g., an N,N-dimethylsulfamoyl group), a hydroxyl group, a sulfo group, a carboxyl group, a nitro group, an alkylamino group (an alkylamino group having 1 to 60 carbon atoms, e.g., a methylamino, diethylamino, octylamino, or octadecylamino group), an arylamino group (an arylamino group having 6 to 60 carbon atoms, e.g., a phenylamino, naphthylamino, or N-methyl-N-phenylamino group), a heterocyclic group (a heterocyclic group which has 0 to 60 carbon atoms and has as a ring-constituting heteroatom, an atom selected preferably from a nitrogen atom, an oxygen atom, and a sulfur atom and which more preferably has a carbon atom in addition to the heteroatom as a constituent of the ring and which is preferably a 3- to 8-membered ring, more preferably a 5- to 6-membered ring, and is, for example, a group previously indicated as an example of Y), an acyloxy group (an acyloxy group having 1 to 60 carbon atoms, e.g., a formyloxy, acetyloxy, myristoyloxy, or benzoyloxy group), and so on.

In the groups listed above, the alkyl group, the cycloalkyl group, the aryl group, the acylamino group, the ureido group, the urethane group, the alkoxy group, the aryloxy group, the alkylthio group, the arylthio group, the acyl group, the sulfonyl group, the cyano group, the carbamoyl group, and the sulfamoyl group include those having a substituent. Examples of the substituent include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group, a sulfamoyl group, and so on.

Among these substituents, an alkyl group, an aryl group, a carbamoyl group, a sulfamoyl group, an alkoxycarbamoyl group, an acylamino group, a sulfonamide group, and a cyano group are preferable.

In the general formula (Y-1), X represents a hydrogen atom or a group that leaves as a result of reacting with an oxidized form of a developing agent. Examples of the group include a halogen atom (e.g., a fluorine, chlorine, or bromine atom), an alkoxy group (e.g., an ethoxy, methoxycarbonylmethoxy, carbonylpropyloxy, methanesulfonylethoxy, or perfluoropropoxy group), an aryloxy group (e.g., a 4-carboxyphenoxy, 4-(4-hydroxyphenylsulfonyl) phenoxy, 4-methanesulfonyl-3-carboxyphenoxy, or 2-methanesulfonyl-4-acetylsulfamoylphenoxy group), an acyloxy group (e.g., an acetoxy or benzoyloxy group), a sulfonyloxy group (e.g., a methanesulfonyloxy or benzenesulfonyloxy group), an acylamino group (e.g., a heptafluorobutylylamino group), a sulfonamide group (e.g., a methanesulfonamide group), an alkoxycarbonyloxy group (e.g., an ethoxycarbonyloxy group), a carbamoyloxy group (e.g., a diethylcarbamoyloxy, piperidinocarbamoyloxy, or morpholinocarbamoyloxy group), an alkylthio groups (e.g., a 2-carboxyethylthio group), an arylthio group (e.g., a 2-octyloxy-5-t-octylphenylthio or 2-(2,4-di-t-amylphenoxy)butylylaminophenylthio group), a heterocyclothio group (e.g., 1-phenyltetrazolylthio or 2-benzimidazolylthio group), a heterocycloxy group (e.g., 2-pyridyloxy or 5-nitropyridyloxy group), a 5- or 6-membered, nitrogen-containing heterocyclic group (e.g., a 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazoline-2,4-dione-3-yl, or 7-purinyl group), an azo group (e.g., 4-methoxyphenylazo or 4-pivaloylaminophenylazo group), and so on.

Alternatively, X may be a leaving group which has a timing function and can liberate a photographic reagent such as a development inhibitor or a development accelerator by an electron transfer via the leaving group or by an intramolecular nucleophilic reaction after leaving.

In the general formula (Y-1), Z represents a substituted aryl group and preferably has 6 to 60 carbon atoms. Examples of the substituent of the aryl group include those groups listed as the substituents that may be linked to Y described previously. Preferred examples of the substituent are halogen atoms, alkyl groups, aryl groups, carbamoyl groups, sulfamoyl groups, alkoxycarbonyl groups, acylamino groups, sulfonamide groups, sulfonyl groups, alkoxy groups, and aryloxy groups.

As a substituent of Z, most preferable is a phenyl group having at least in a 2-position thereof a halogen substituent or an alkoxy substituent (the phenyl group may further have substituents in 3- to 6-positions and it is particularly preferable that is has a substituent in a 5-position).

The coupler, which is represented by the general formula (Y-1) and is preferably used in the present invention, may form a dimer or a polymer, or alternatively, may be linked to a polymer chain via Y or Z. Examples of the couplers [(1) to (39)], which are represented by the general formula (Y-1) and are preferably used in the present invention, are given below. However, it should be noted that the present invention is not limited to these couplers.

(1)

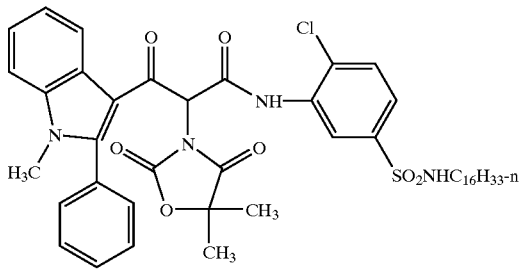

(2)

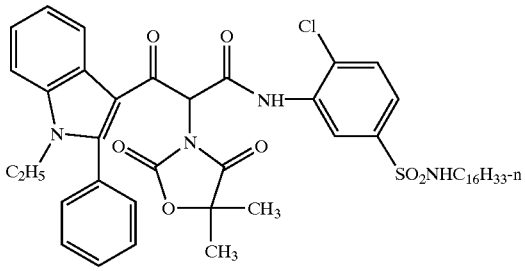

(3)

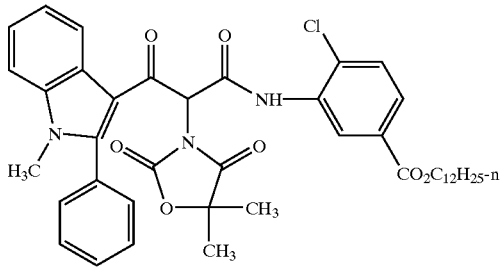

(4)

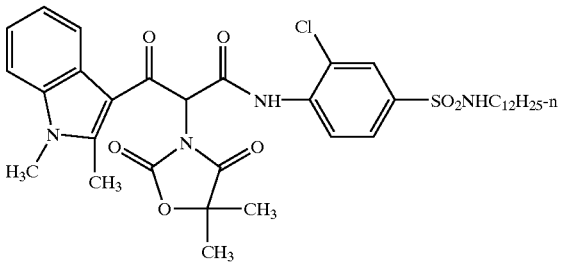

(5)

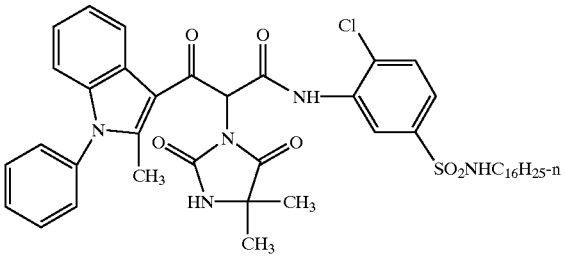

-continued (6)

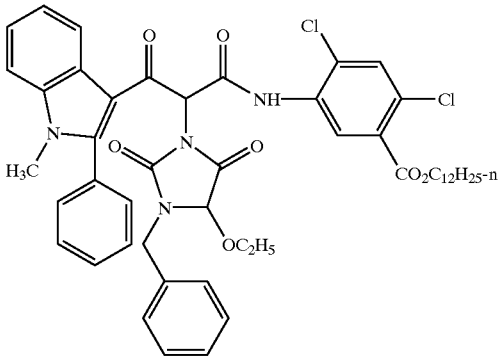

(7)

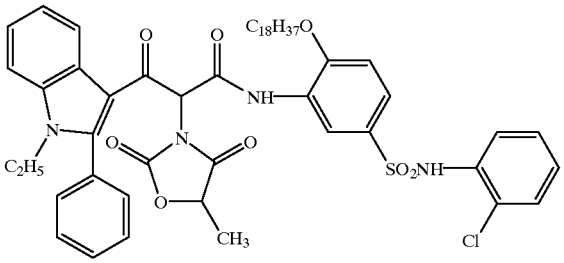

(8)

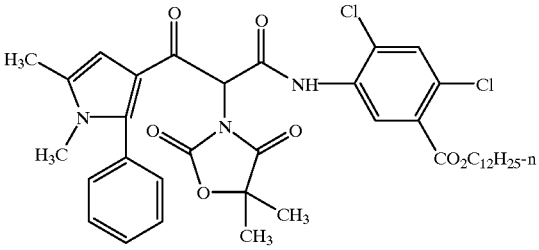

(9)

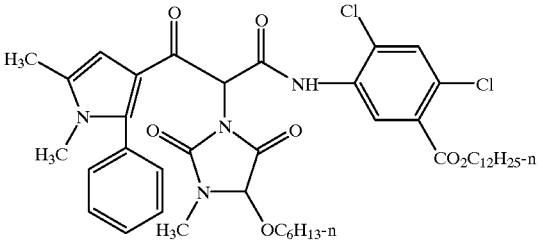

(10)

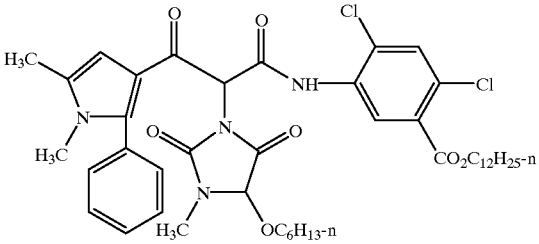

-continued
(11)
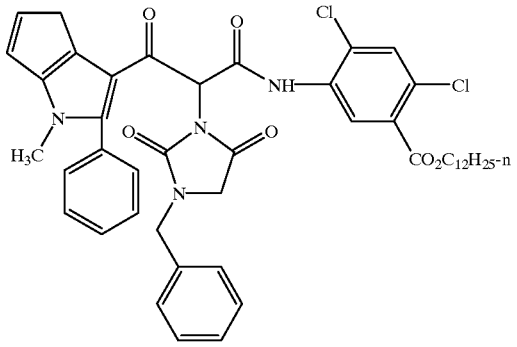
(12)
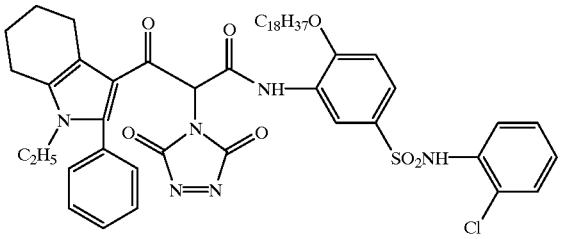
(13)
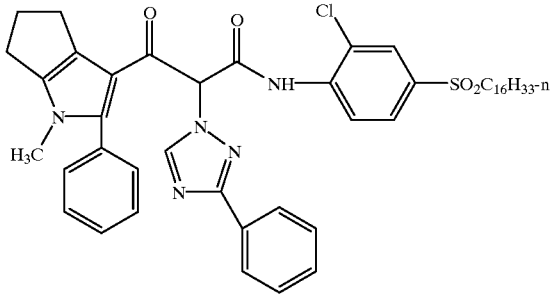
(14)
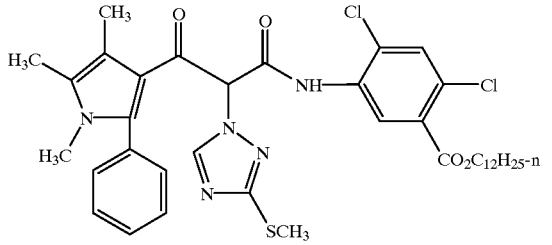
(15)
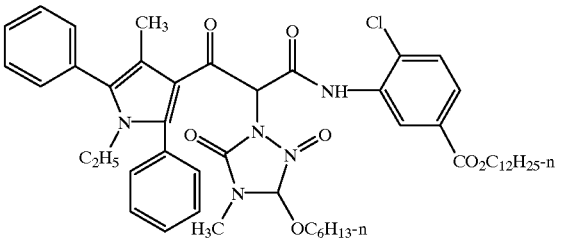
-continued
(16)
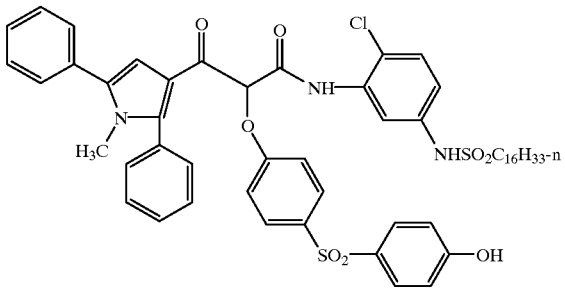
(17)
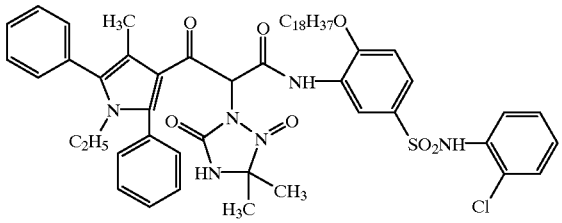
(18)
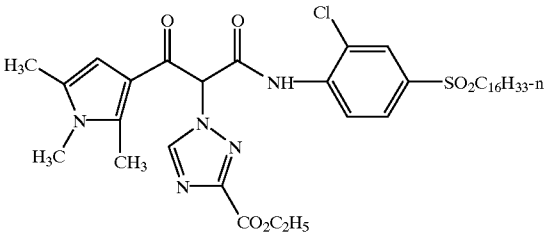
(19)
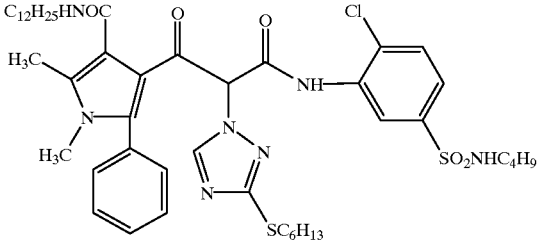
(20)
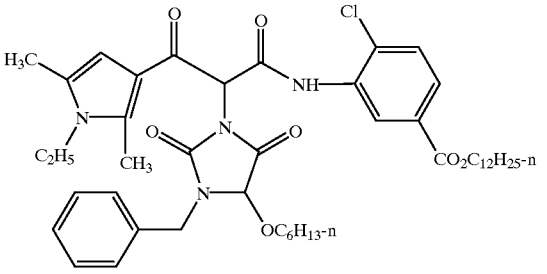
(21)
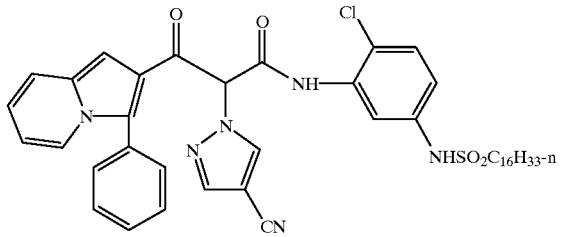

-continued
(22)
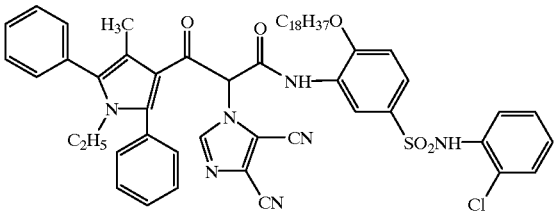
(23)
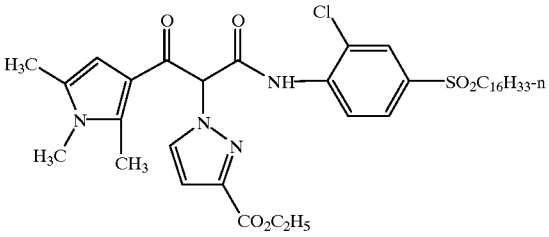
(24)
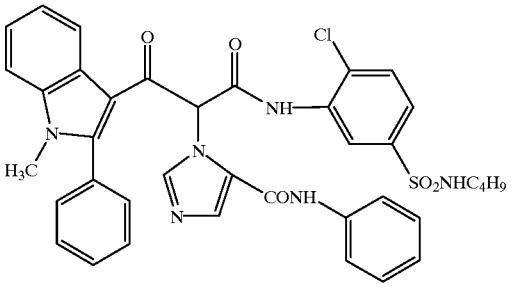
(25)
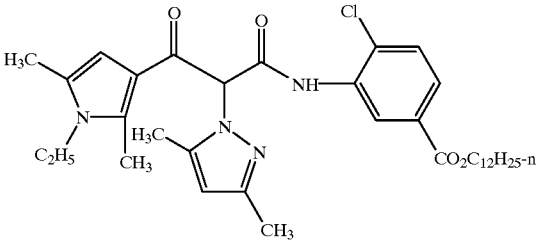
(26)
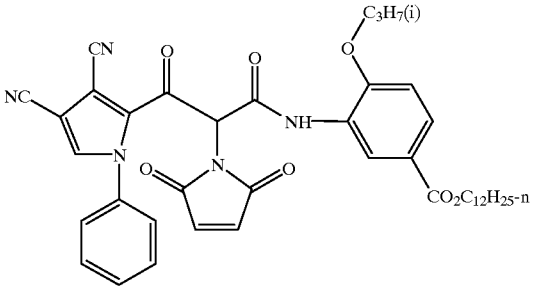
-continued
(27)
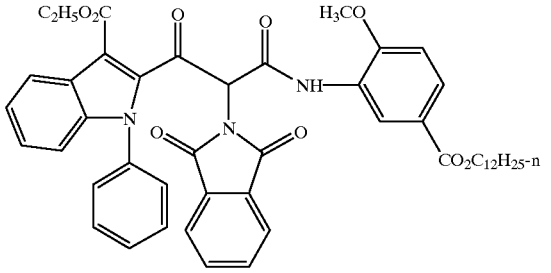
(28)
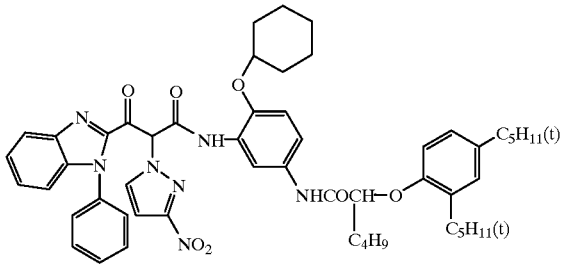
(29)
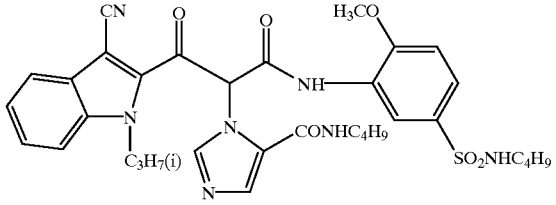
(30)
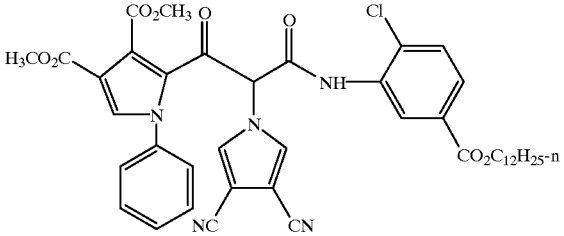
(31)
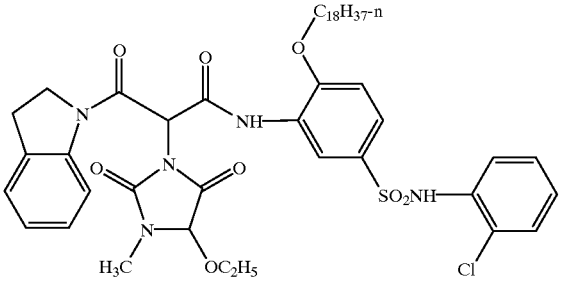

-continued
(32)
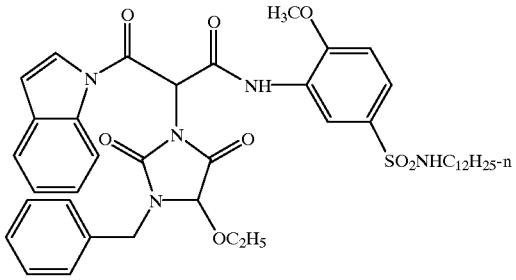
(33)
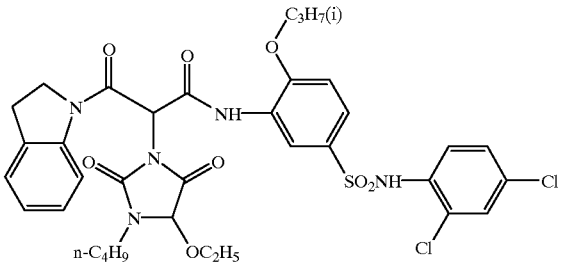
(34)
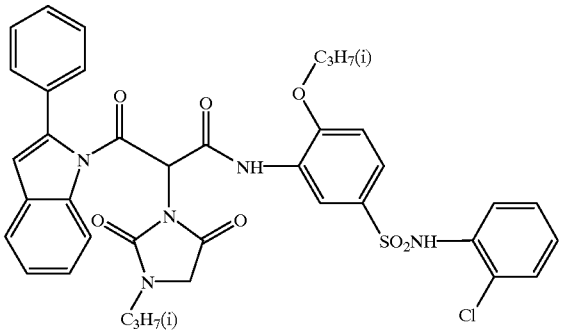
(35)
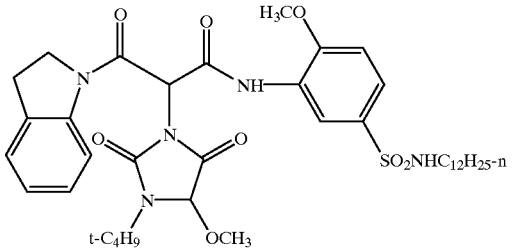
-continued
(36)
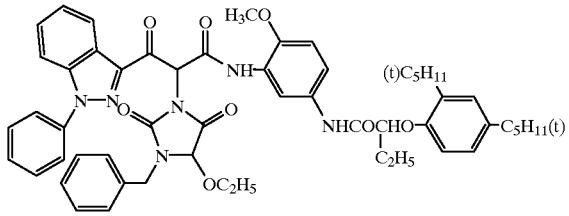
(37)
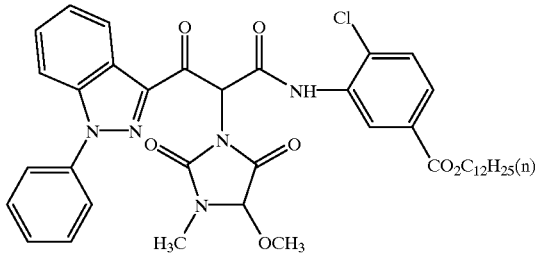
(38)
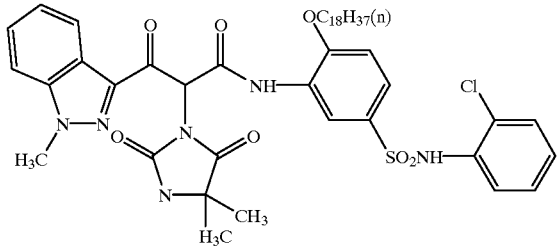
(39)
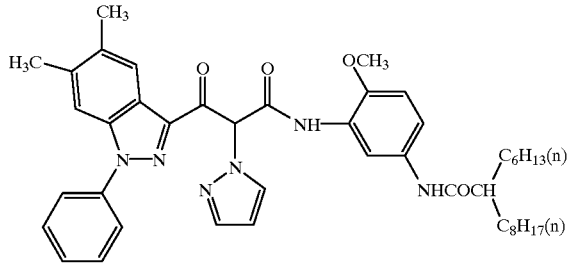
The couplers of the present invention can be synthesized by the methods described in EP Laid-Open Patent Application Nos. 953,871, 953,873, 953,874, etc. One of these examples is described below.
SYNTHESIS EXAMPLE
Synthesis of Coupler (6)
The synthesis of the coupler (6) was carried out according to the following method.

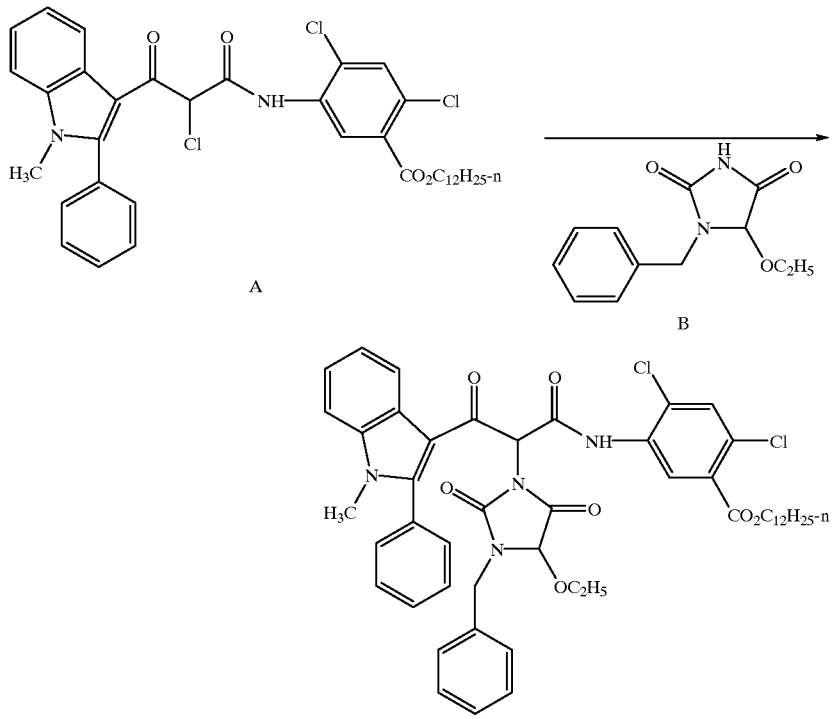

6.5 g of the compound A, which was synthesized according to the method described in EP Laid-Open Patent Application No. 953,870, and 5.82 g of a compound B were dissolved in 50 mL of dimethylacetamide. After that, 3.5 mL of triethylamine was added to the solution. The resulting solution was subjected to a reaction at 70° C. for 2 hours. Upon completion of the reaction, 100 mL of ethyl acetate was added to the solution and the resulting solution was washed with water. The organic layer was dried by using magnesium sulfate and thereafter the ethyl acetate was distilled off. Hexane was added to the residue so as to deposit crystals. The crystals were collected by filtration. In this way, 7.5 g of the target exemplary compound (6) was obtained.

The yellow coupler of the present invention is used in an amount falling within a range of 0.001 to 1 mole, preferably within a range of 0.003 to 0.5 mole, per mole of the photosensitive silver halide in the same layer.

In the present invention, the component insoluble in water but soluble in an organic solvent refers to a component whose solubility in water is less than 1 weight % and solubility in ethyl acetate is more than 1 weight %. More specifically, this component indicates substance composed of oil droplets such as a coupler or a high-boiling-point organic solvent in oil-in-water type dispersing method.

In the present invention, gelatin is preferably used as a hydrophilic colloid. If necessary, an other hydrophilic colloid may replace an arbitrary proportion of the gelatin. Examples of the other hydrophilic colloid include gelatin derivatives, graft polymers made up of gelatin and other polymer, proteins such as albumin or casein, cellulose derivatives (e.g., hydroxyethylcellulose, carboxymethylcellulose, cellulose sulfate ester, and the like), saccharide such as sodium alginate and starch derivatives, and a wide range of synthetic polymers such as polyvinyl alcohol, partially acetalized polyvinyl alcohol, poly(N-vinylpyrrolidone), polyacrylic acid, polymethacrylic acid, polyacrylamide, polyvinylimidazole, polyvinylpyrazole, and the like.

From the viewpoint of the effect of the present invention, in the emulsion layer containing a coupler represented by the general formula (Y-1), the ratio of the component insoluble in water but soluble in an organic solvent to the hydrophilic binder needs to be 0.75 or less, that is, it needs to be 0.75 to 0.00. The ratio is more preferably 0.75 to 0.05 and most preferably 0.65 to 0.10.

Next, dyes represented by the general formula [I] are described.

In the general formula (I), D represents a residue of a compound having a chromophoric group, X represents a dissociative hydrogen atom or a group having a dissociative hydrogen atom, and y is an integer of 1 to 7. The dyes represented by the general formula [I] are characterized in that these dyes have in the molecular structure thereof a dissociative hydrogen atom or the like.

The compound residue D, which has a chromophoric group, can be selected from many conventionally known dyes.

Examples of these compounds include oxonol dyes, merocyanine dyes, cyanine dyes, allylidene dyes, azomethine dyes, triphenylmethane dyes, azo dyes, anthraquinone dyes, and indoaniline dyes.

X represents a dissociative hydrogen or a dissociative hydrogen-bearing group linked directly or via a bivalent linking group to D.

The bivalent linking group between X and D is an alkylene group, an arylene group, a heterocyclic residue, —CO—, —$SO_n$— (n=0, 1, 2), —NR— (R represents a hydrogen atom, an alkyl group, or an aryl group), —O—, or a bivalent group made up of a combination of these linking groups. The bivalent linking group may have a substituent such as an alkyl group, an aryl group, an alkoxy group, an amino group, an acylamino group, a halogen atom, a hydroxyl group, a carboxyl group, a sulfamoyl group, a carbamoyl group, a sulfonamide group, or the like. Preferred examples thereof include $—(CH_2)_n—$ (n=1, 2, 3), $—CH_2CH(CH_3)CH_2—$, 1,2-phenylene, 5-carboxy-1,3-phenylene, 1,4-phenylene, 6-methoxy-1,3-phenylene, $—CONHC_6H_4—$, and so on.

Where the dye represented by the general formula [I] is contained in the silver halide photographic photosensitive material of the present invention, the group, which is represented by X and is a dissociative hydrogen or a dissociative hydrogen-bearing group, is not dissociated and makes the dye represented by the general formula [I] substantially insoluble in water. In the step in which the photosensitive material is processed for development, the groups represented by X become dissociated and make the dye represented by the general formula [I] substantially soluble in water. Examples of the group, which is represented by X and is a dissociative hydrogen-bearing group, include groups having such groups as a carboxyl group, a sulfonamide group, a sulfamoyl group, a sulfonylcarbamoyl group, an acylsulfamoyl group, and a phenolic hydroxyl group. Examples of the dissociative hydrogen represented by X include the hydrogen of the enol group of an oxonol dye.

The preferred range of y is 1 to 5 and the particularly preferred range is 1 to 3.

Among the compounds represented by the general formula [I], preferable is a compound in which the dissociative hydrogen-bearing group as X is a carboxyl-bearing group and particularly preferable is a compound having a carboxyl-substituted aryl group.

Among the dyes represented by the general formula [I], more preferable are compounds represented by the following general formula [II] or the following general formula [III].

General formula [II]

$$A^1{=}L^1{—}(L^2{=}L^3)_m{—}Q$$

In the general formula [II], $A^1$ represents an acidic nucleus. Q represents an aryl group or a heterocyclic group. $L^1$, $L^2$, and $L^3$ each represents a methine group. m represents 0, 1, or 2. It is necessary that the compounds represented by the general formula [II] each has in the molecule thereof 1 to 7 units (preferably of carboxyl groups) selected from the group consisting of a carboxyl group, a sulfonamide group, a sulfamoyl group, a sulfonylcarbamoyl group, an acylsulfamoyl group, and a phenolic hydroxyl group as dissociative hydrogen-bearing groups, and the enol group of an oxonol dye as a dissociative hydrogen.

General formula [III]

$$A^1{=}L^1{—}(L^2{=}L^3)_n{—}A^2$$

In the general formula [III], $A^1$ and $A^2$ each represents an acidic nucleus. $L^1$, $L^2$, and $L^3$ each represents a methine group. n represents 1 or 2. It is necessary that the compounds represented by the general formula [III] each has in the molecule thereof 1 to 7 units (preferably of carboxyl groups) selected from the group consisting of a carboxyl group, a sulfonamide group, a sulfamoyl group, a sulfonylcarbamoyl group, an acylsulfamoyl group, and a phenolic hydroxyl group as dissociative hydrogen-bearing groups, and the enol group of an oxonol dye as a dissociative hydrogen.

General formulae [II] and [III] are explained in detail below.

The acidic nuclei represented by $A^1$ or $A^2$ are preferably those derived from ketomethylene compounds or from compounds having a methylene group sandwiched between electron-withdrawing groups.

Examples of the ketomethylene compounds include 2-pyrazoline-5-one, rhodanine, hydantoin, thiohydantoin, 2,4-oxazoline-dione, isooxazoline, barbituric acid, thiobarbituric acid, indandione, dioxopyrazolopyridine, hydroxypyridone, pyrazolidinedione, and 2,5-dihydrofuran.

The compounds having a methylene group sandwiched between electron-withdrawing groups can be represented by $Z^1CH_2Z^2$, wherein $Z^1$ and $Z^2$ each represents —CN, $—SO_2R^{11}—$, $—COR^{11}$, $—COOR^{12}$, $—CONHR^{12}—$, $—SO_2NHR^{12}—$, or $—C[{=}C(CN)_2R^{11}—$. $R^{11}$ represents an alkyl group, an aryl group, or a heterocyclic group. $R^{12}$ represents a hydrogen atom or a group represented by $R^{11}$ and these groups may each have a substituent.

Examples of the aryl group represented by Q include a phenyl group and a naphthyl group. These groups may each have a substituent. Examples of the heterocyclic group represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxodiazole, benzoquinoline, thiadiazole, pyrrolothiazole, pyrrolopyridazine, tetrazole, oxazole, coumarin, and coumarone. These may each have a substituent.

The methine group represented by $L_1$, $L_2$, or $L_3$ may each have a substituent and these substituent may join together to thereby form a 5- or 6-membered ring (e.g., cyclopentene or cyclohexene).

The substituents that may be borne by the groups described above are not particularly limited with the proviso these substituents are not those compounds represented by the general formulae [I] to [III] which are substantially soluble in water and have a pH value of 5 to 7. For example, the substituents may be as follows.

A carboxyl group, a sulfonamide group having 1 to 10 carbon atoms (e.g., a methanesulfonamide, benzenesulfonamide, butanesulfonamide, or n-octanesulfonamide group), an unsubstituted or alkyl- or aryl-substituted sulfamoyl group having 0 to 10 carbon atoms (e.g., an unsubstituted sulfamoyl, methylsulfamoyl, phenylsulfamoyl, naphthylsufamoyl, or butylsulfamoyl group), a sulfonylcarbamoyl group having 2 to 10 carbon atoms (e.g., a methanesulfonylcarbamoyl, propanesulfonylcarbamoyl, or benzenesulfonylcarbamoyl group), an acylsulfamoyl group having 1 to 10 carbon atoms (e.g., an acetylsulfamoyl, propionylsulfamoyl, pivaloylsulfamoyl, or benzoylsulfamoyl group), a straight-chain or cyclic alkyl group having 1 to 8 carbon atoms (e.g., a methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, or 2-diethylaminoethyl group), an alkenyl group having 2 to 8 carbon atoms (e.g., a vinyl or allyl group), an alkoxy group having 1 to 8 carbon atoms (e.g., a methoxy, ethoxy, or butoxy group), a halogen atom (e.g., F, Cl, or Br atom), an amino group having 0 to 10 carbon atoms (e.g., an unsubstituted amino, dimethylamino, diethylamino, or carboxyethylamino group), an ester group having 2 to 10 carbon atoms (e.g., a methoxycarbonyl group), an amido group having 1 to 10 carbon atoms e.g., an acetylamino or benzamido group), a carbamoyl group having 1 to 10 carbon atoms (e.g., an unsubstituted carbamoyl, methylcarbamoyl, or ethylcarbamoyl group), an aryl group having 6 to 10 carbon atoms (e.g., a phenyl, naphthyl, hydroxyphenyl, 4-carboxylphenyl, 3-carboxyphenyl, 3,5-dicarboxyphenyl, 4-methanesulfonamidephenyl, or 4-butanesulfonamidephenyl group), an aryloxy group having 6 to 10 carbon atoms (e.g., a phenoxy, 4-carboxylphenoxy, 3-methylphenoxy, or naphthoxy group), an alkylthio group having 1 to 8 carbon atoms (e.g., a methylthio, ethylthio, or octylthio group), an arylthio group having 6 to 10 carbon atoms (e.g., a phenylthio or naphthylthio group), an acyl group having 1 to 10 carbon atoms (e.g., an acetyl, benzoyl, or propanoyl group), a sulfonyl group having 1 to 10 carbon atoms (e.g., a methanesulfonyl or benzenesulfonyl group), a ureido group having 1 to 10 carbon atoms (e.g., a ureido or methylureido group), a urethane group having 2 to 10 carbon atoms (e.g., a methoxycarbonylamino or ethoxycarbonylamino group), a cyano group, a hydroxyl group, a nitro group, a heterocyclic group (e.g., a 5-carboxybenzoxazole, pyridine, sulfolane, pyrrole, pyrrolidine, morpholine, piperazine, pyrimidine, or furan ring).

Among the compounds represented by the general formula [III], more preferable are the compounds represented by the following general formula [IV]. The compounds represented by the general formula [IV] contain as a dissociative hydrogen atom, the hydrogen of an enol group.

General formula [IV]

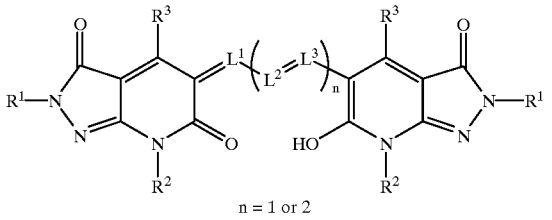

In the general formula [IV], $R^1$ represents a hydrogen atom, an alkyl group, an aryl group, or a heterocyclic group; $R^2$ represents a hydrogen atom, an alkyl group, an aryl group, a heterocyclic group, —$COR^4$, or —$SO_2R^4$; and $R^3$ represents a hydrogen atom, a cyano group, a hydroxyl group, a carboxyl group, an alkyl group, an aryl group, —$CO_2R^4$—, —$OR^4$, —$NR^5R^6$, —$CONR^5R^6$, —$NR^5COR^4$, —$NR^5SO_2R^4$, or —$NR^5CONR^5R^6$ (wherein $R^4$ represents an alkyl group or an aryl group; and $R^5$and $R^6$ each represents a hydrogen atom, an alkyl group, or an aryl group). $L^1$, $L^2$, and $L^3$ each represents a methine group. n represents 1 or 2.

In the formula [IV], examples of the alkyl group which is $R^1$ include an alkyl group having 1 to 4 carbon atoms, e.g., a cyanoethyl, 2-hydroxyethyl, or carboxybenzyl group; examples of the aryl group include phenyl, 2-methylphenyl, 2-carboxyphenl, 3-carboxyphenl, 4-carboxyphenl, 3,6-dicarboxyphenl, 2-hydroxypheny, 3-hydroxypheny, 4-hydroxypheny, 2-chloro-4-hydroxypheny, and 4-methylsulfamoylphenyl groups; and examples of the heterocyclic group include 5-carboxybenzoxazole-2-il.

Examples of the alkyl group which is $R^2$ include an alkyl group having 1 to 4 carbon atoms, e.g., a carboxymethyl, 2-hydroxyethyl, or 2-methoxyethyl group; examples of the aryl group include 2-carboxyphenyl, 3-carboxyphenyl, 4-carboxyphenyl, and 3,6-dicarboxyphenyl group; and examples of the heterocyclic group include a pyridyl group. Examples of —$COR^4$ include an acetyl, and examples of —$SO_2R^4$ include methane sulfonyl.

Examples of the alkyl group which are $R^3$, $R^4$, $R^5$ and $R^6$ include an alkyl group having 1 to 4 carbon atoms. Examples of the aryl group as $R^3$, $R^4$, $R^5$ and $R^6$ include a phenyl group and a methylphenyl group.

In the present invention, $R^1$ is preferably a carboxy-substituted phenyl group (e.g., a 2-carboxyphenyl, 3-carboxyphenyl, 4-carboxyphenyl, or 3,6-dicarboxyphenyl group).

Specific examples of the compounds [(I-1~14), (II-1~24), (III-1~25), and (IV-1~51)] represented by the general formulae [I] to [IV] are given below. However, it should be noted that the present invention is not limited to these compounds.

(I-1)

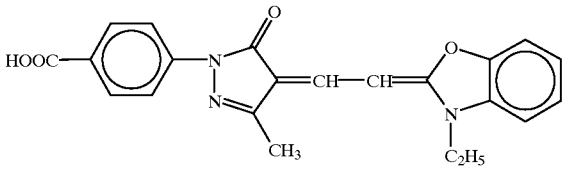

(I-2)

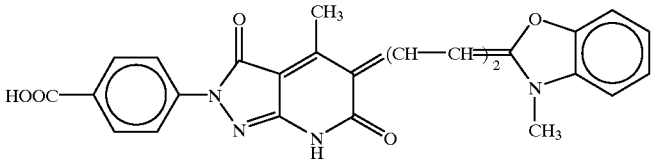

-continued
(I-3)
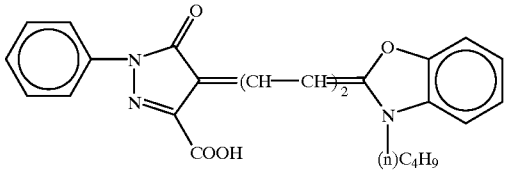
(I-4)
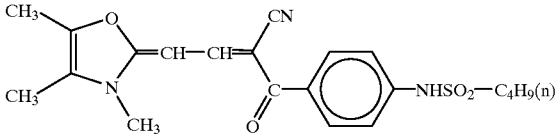
(I-5)
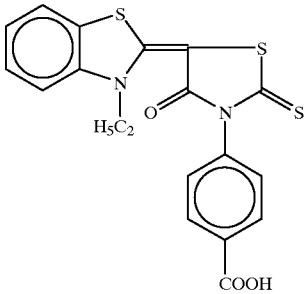
(I-6)
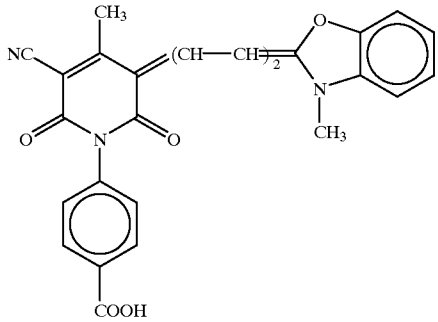
(I-7)
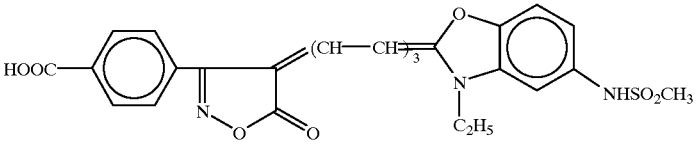
(I-8)
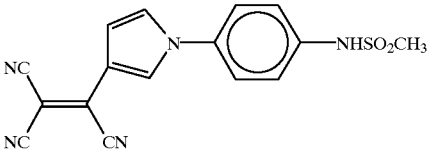
(I-9)
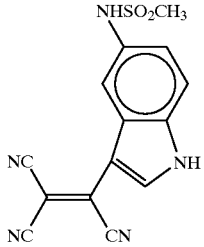
(I-10)
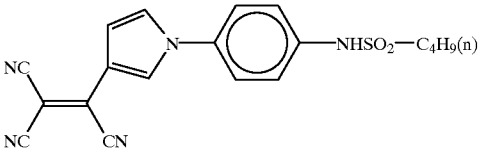
(I-11)
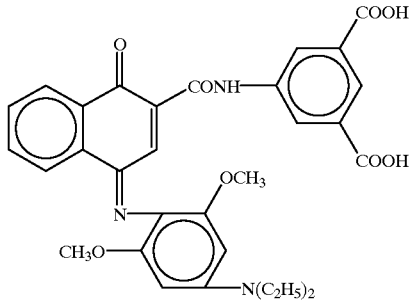
(I-12)
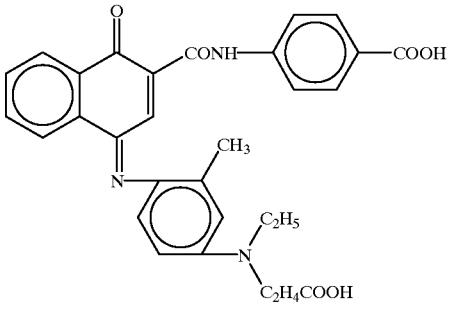
(I-13)
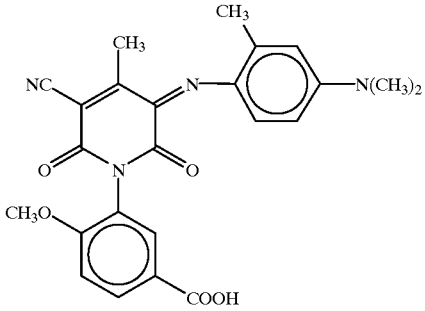

-continued
(I-14)
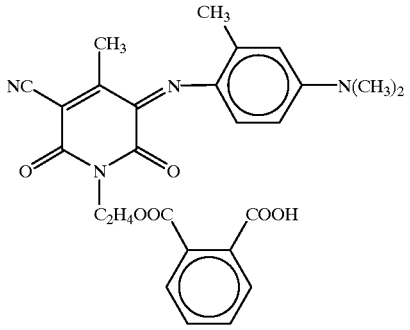
(II-1)
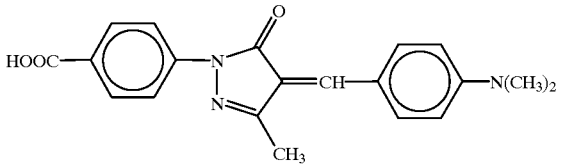
(II-2)
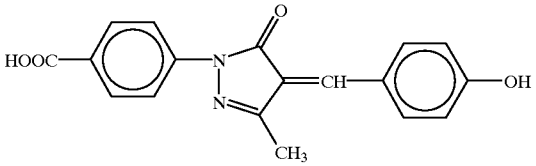
(II-3)
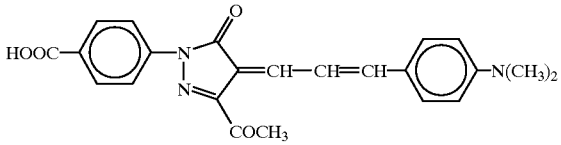
(II-4)
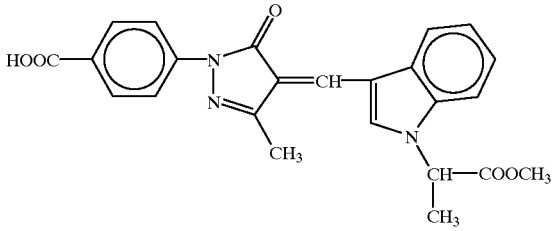
(II-5)
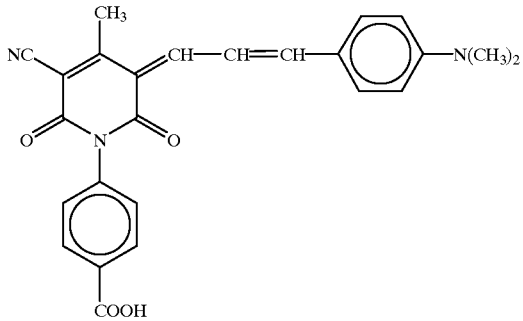
(II-6)
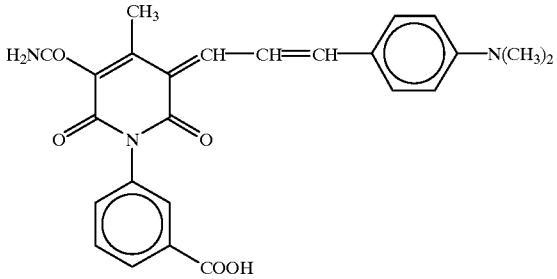
(II-7)
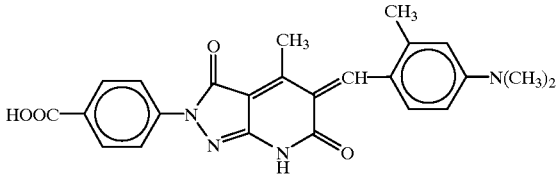
(II-8)
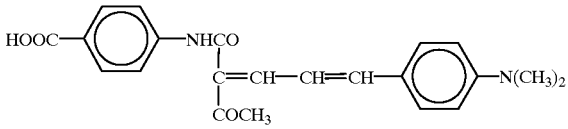
(II-9)
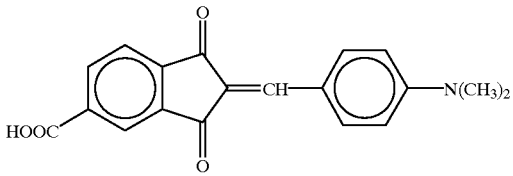

-continued
(II-10)
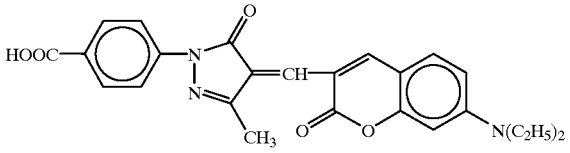
(II-11)
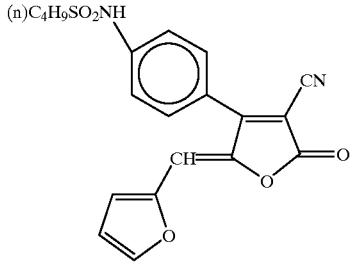
(II-12)
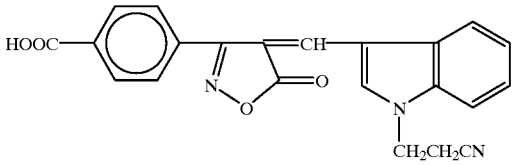
(II-13)
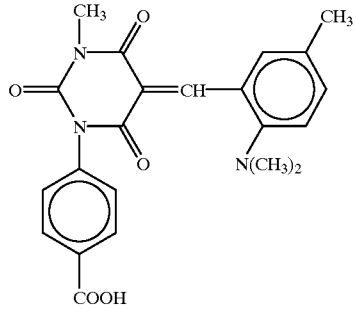
(II-14)
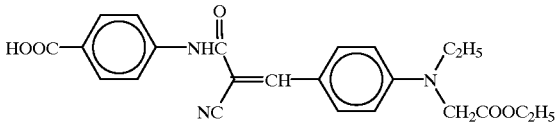
(II-15)
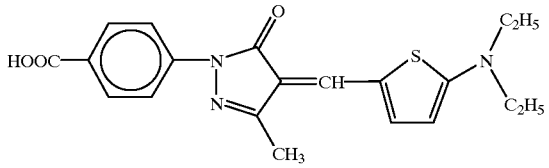
(II-16)
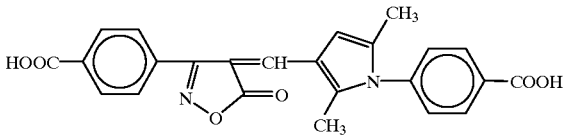
(II-17)
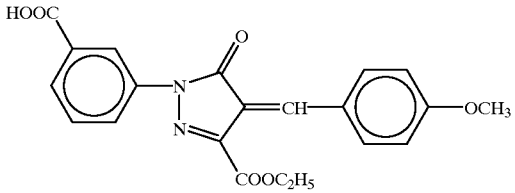
(II-18)
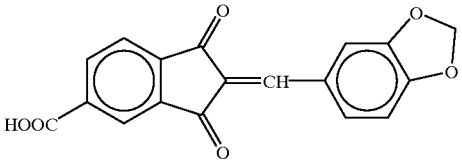
(II-19)
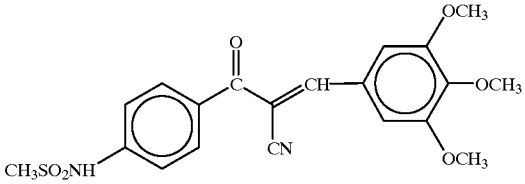
(II-20)
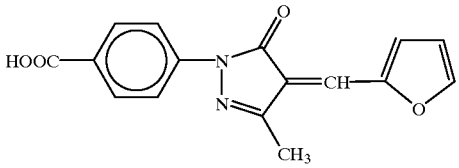
(II-21)
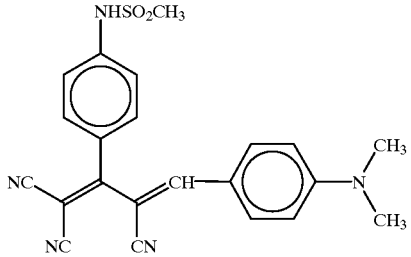

-continued
(II-22)
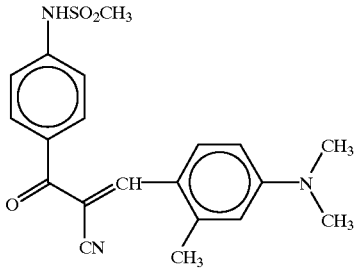
(II-23)
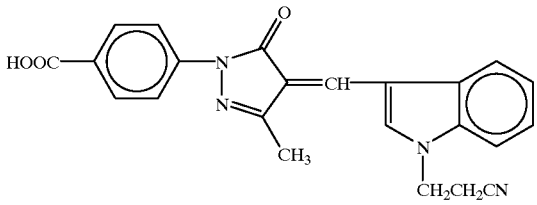
(II-24)
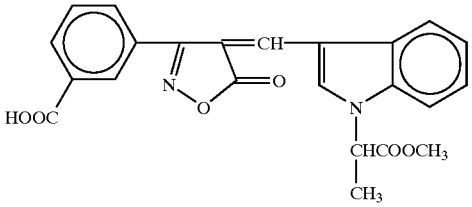
(III-1)
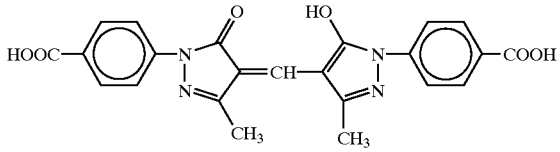
(III-2)
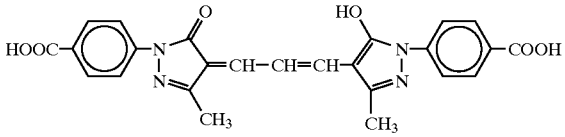
(III-3)
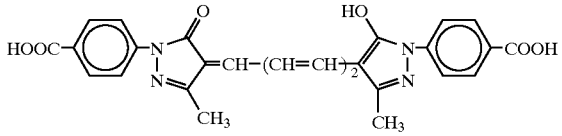
(III-4)
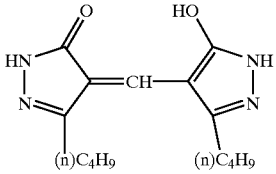
(III-5)
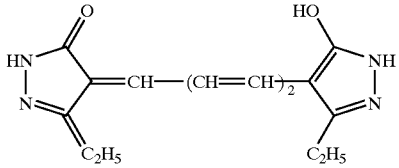
(III-6)
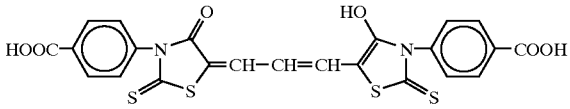
(III-7)
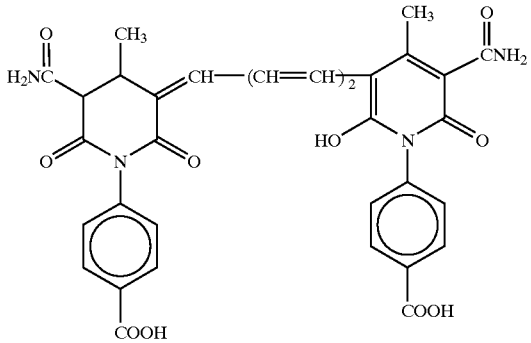
(III-8)
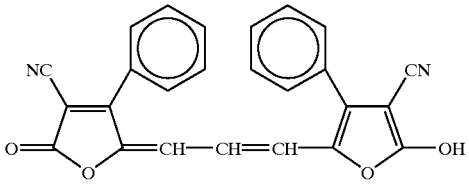

-continued
(III-9)
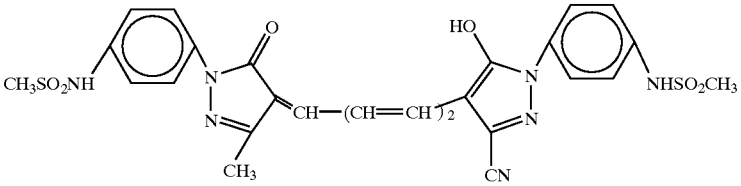
(III-10)
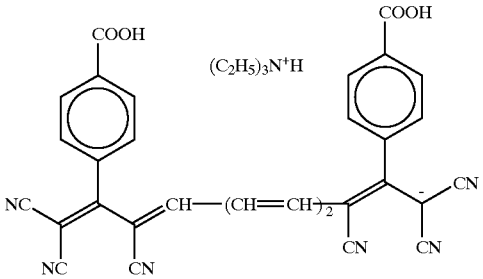
(III-11)
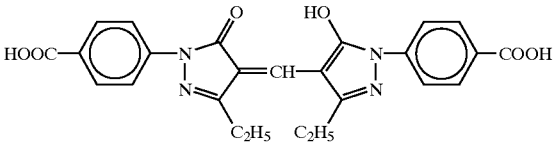
(III-12)
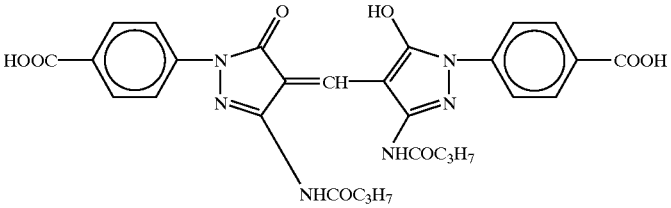
(III-13)
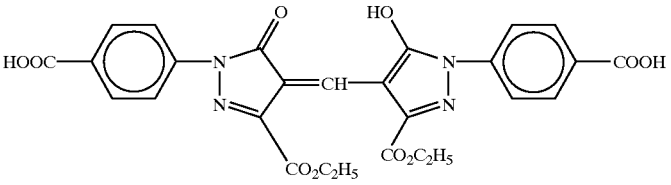
(III-14)
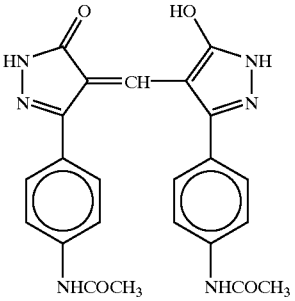
(III-15)
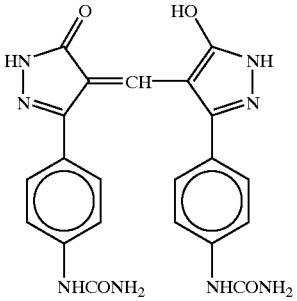
(III-16)
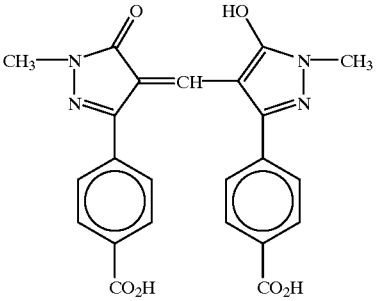
(III-17)
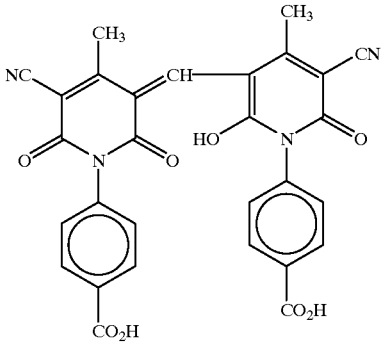

-continued
(III-18)
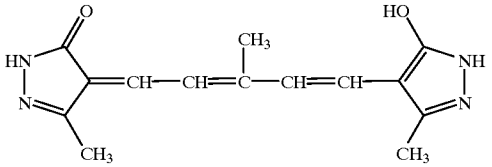
(III-19)
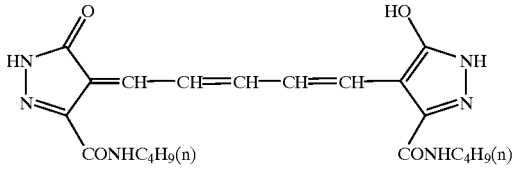
(III-20)
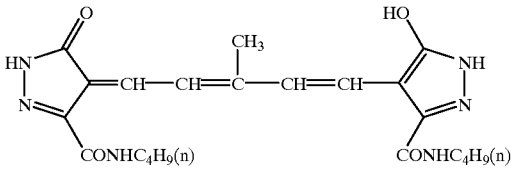
(III-21)
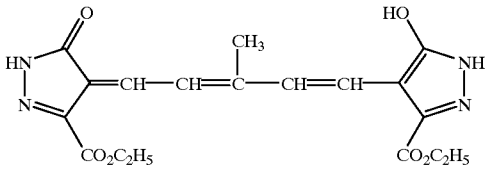
(III-22)
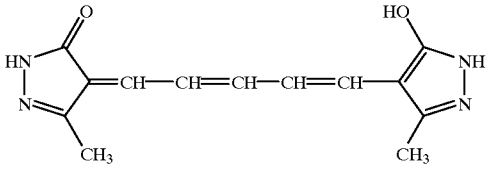
(III-23)
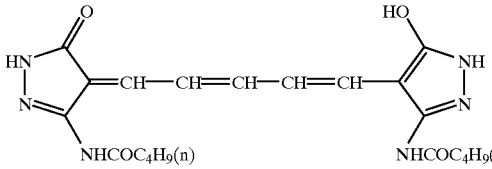
(III-24)
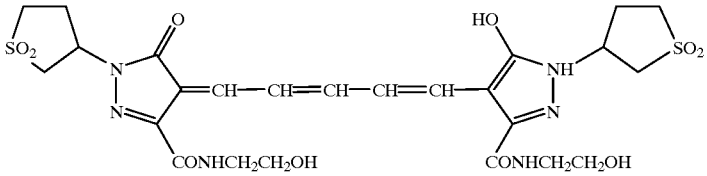
(III-25)
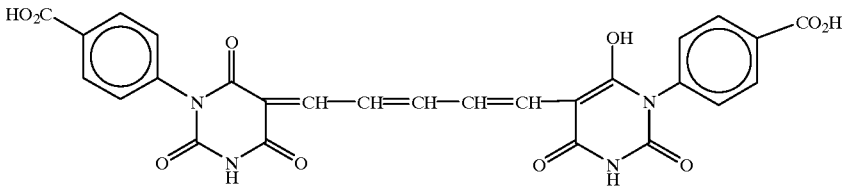
TABLE 1
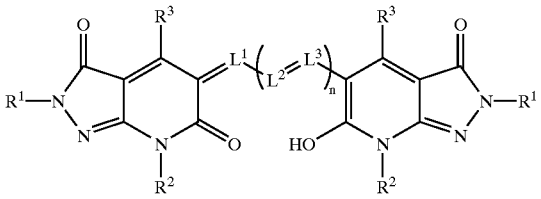
| | $R^1$ | $R^2$ | $R^3$ | $=L^1-(L^2=L^3)_n-$ |
|---|---|---|---|---|
| IV-1 | 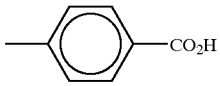 | —H | $-CH_3$ | =CH—CH=CH— |
| IV-2 | 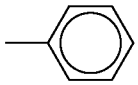 | —H | $-CH_3$ | =CH—CH=CH— |

TABLE 1-continued
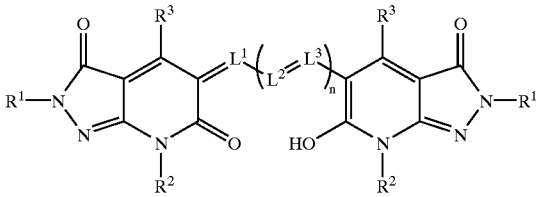
| | $R^1$ | $R^2$ | $R^3$ | $=L^1-(L^2=L^3)_n-$ |
|---|---|---|---|---|
| IV-3 | $-CH_3$ | $-H$ | $-CH_3$ | $=CH-CH=CH-$ |
| IV-4 | 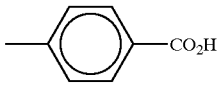 | $-CH_3$ | $-CH_3$ | $=CH-CH=CH-$ |
| IV-5 | 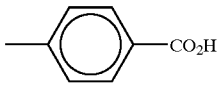 | 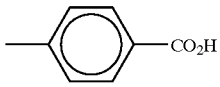 | $-CH_3$ | $=CH-CH=CH-$ |
| IV-6 | 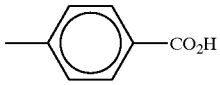 | $-CH_3$ | $-CO_2C_2H_5$ | $=CH-CH=CH-$ |
| IV-7 | 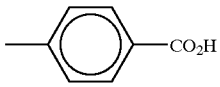 | $-CH_3$ | $-CO_2H$ | $=CH-CH=CH-$ |
| IV-8 | $-CH_3$ | 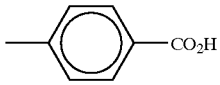 | $-CH_3$ | $=CH-CH=CH-$ |
| IV-9 | $-CH_3$ | 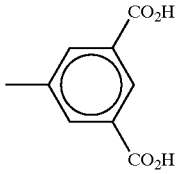 | $-CH_3$ | $=CH-CH=CH-$ |
| IV-10 | $-CH_3$ | $-CH_3$ | $-CH_3$ | $=CH-CH=CH-$ |
| IV-11 | 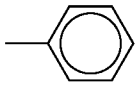 | 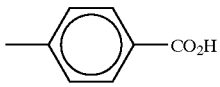 | $-CH_3$ | $=CH-CH=CH-$ |
| IV-12 | 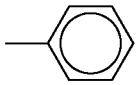 | 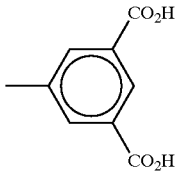 | $-CH_3$ | $=CH-CH=CH-$ |
| IV-13 | 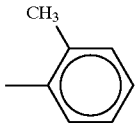 | 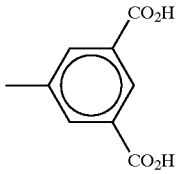 | $-CH_3$ | $=CH-CH=CH-$ |
| IV-14 | 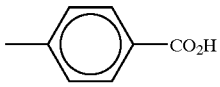 | $-H$ | $-CH_3$ | 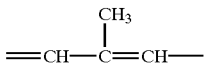 |

TABLE 1-continued
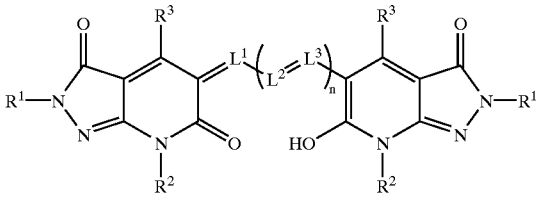
| | $R^1$ | $R^2$ | $R^3$ | $=L^1-(L^2=L^3)_n-$ |
|---|---|---|---|---|
| IV-15 | 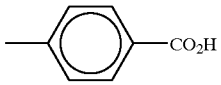 | —H | $-CO_2C_2H_5$ | =CH—CH=CH— |
| IV-16 | 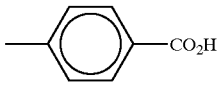 | —H | $-CO_2H$ | =CH—CH=CH— |
| IV-17 | 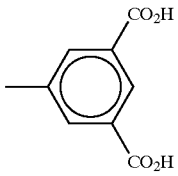 | —H | $-CH_3$ | =CH—CH=CH— |
| IV-18 | 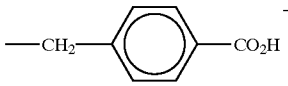 | —H | $-CH_3$ | 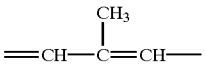 |
| IV-19 | 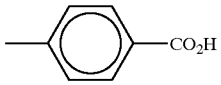 | $-CH_2CH_2OH$ | —H | =CH—CH=CH— |
| IV-20 | 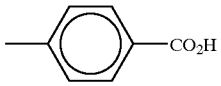 | $-CH_2CO_2H$ | $-CH_3$ | 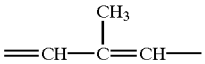 |
| IV-21 | 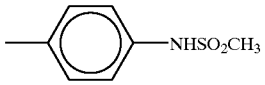 | —H | $-CH_3$ | =CH—CH=CH— |
| IV-22 | 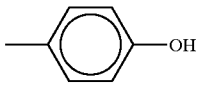 | —H | $-CH_3$ | =CH—CH=CH— |
| IV-23 | $-CH_2CH_2OH$ | —H | $-CH_3$ | =CH—CH=CH— |
| IV-24 | $-CH_3$ | $-CH_2CH_2OH$ | $-CH_3$ | =CH—CH=CH— |
| IV-25 | —H | 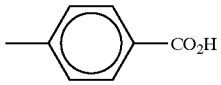 | $-CH_3$ | =CH—CH=CH— |
| IV-26 | —H | —H | $-CH_2H$ | =CH—CH=CH— |
| IV-27 | 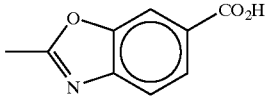 | —H | $-C_2H_5$ | =CH—CH=CH— |
| IV-28 | 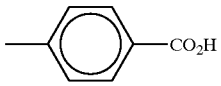 | $-SO_2CH_3$ | $-CO_2CH_3$ | 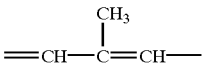 |

TABLE 1-continued
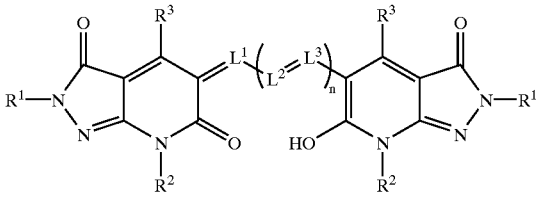
| | $R^1$ | $R^2$ | $R^3$ | $=L^1-(L^2=L^3)_n-$ |
|---|---|---|---|---|
| IV-29 | 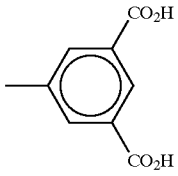 | $-COCH_3$ | $-CH_3$ | $=CH-CH=CH-$ |
| IV-30 | $-H$ | 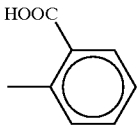 | $-CH_3$ | $=CH-CH=CH-$ |
| IV-31 | 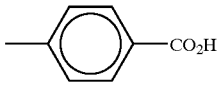 | 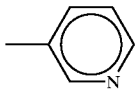 | $-CH_3$ | 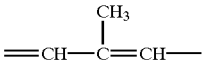 |
| IV-32 | 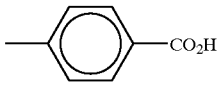 | $-CH_3$ | $-CN$ | $=CH-CH=CH-$ |
| IV-33 | 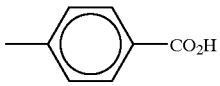 | $-H$ | $-H$ | $=CH-CH=CH-$ |
| IV-34 | 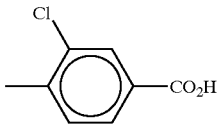 | $-H$ | $-OC_2H_5$ | $=CH-CH=CH-$ |
| IV-35 | 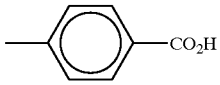 | $-H$ | $(n)C_4H_9-$ | $=CH-CH=CH-$ |
| IV-36 | 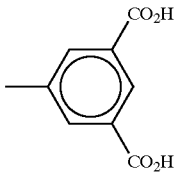 | $-CH_3$ | $-NHCH_3$ | $=CH-CH=CH-$ |
| IV-37 | 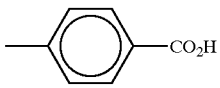 | $-COCH_3$ | $-NHCOCH_3$ | $=CH-CH=CH-$ |
| IV-38 | 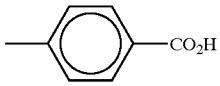 | $-CO_2CH_3$ | $-NHSO_2CH_3$ | $=CH-CH=CH-$ |

TABLE 1-continued
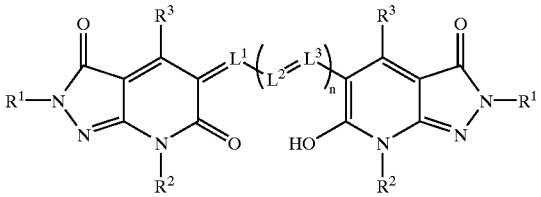
| | $R^1$ | $R^2$ | $R^3$ | $=L^1-(L^2=L^3)_n-$ |
|---|---|---|---|---|
| IV-39 | 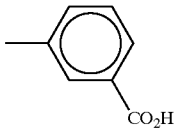 | $-CH_2CH_2OH$ | $-CH_3$ | $=CH-CH=CH-$ |
| IV-40 | $-CH_2CH_2CN$ | $-H$ | $-CH_3$ | $=CH-CH=CH-$ |
| IV-41 | 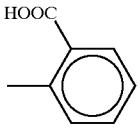 | $-H$ | $-CH_3$ | $=CH-CH=CH-$ |
| IV-42 | 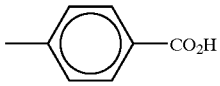 | $-H$ | $-C_2H_5$ | $=CH-CH=CH-$ |
| IV-43 | 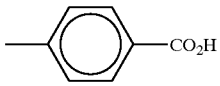 | $-CH_2CH_2OCH_3$ | $-CH_3$ | 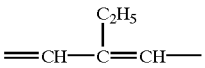 |
| IV-44 | 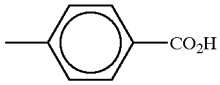 | $-H$ | $-CH_3$ | 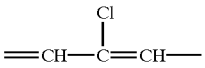 |
| IV-45 | 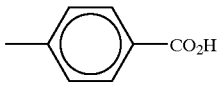 | $-H$ | $-CO_2H$ | 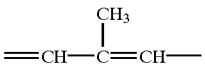 |
| IV-46 | 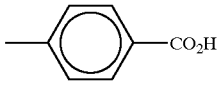 | $-H$ | $-CO_2H$ | 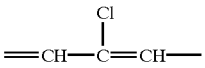 |
| IV-47 | $-CH_2CH_2CN$ | 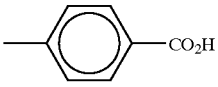 | $-CH_3$ | $=CH-CH=CH-$ |
| IV-48 | $-CH_2CH_2CN$ | 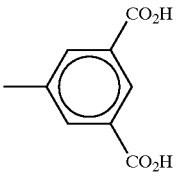 | $-CH_3$ | $=CH-CH=CH-$ |
| IV-49 | 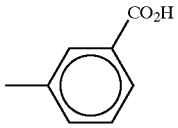 | $-H$ | $-CH_3$ | $=CH-CH=CH-$ |
| IV-50 | 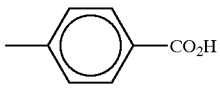 | $-H$ | $-CH_3$ | $=-CH=CH-CH=CH-$ |

TABLE 1-continued

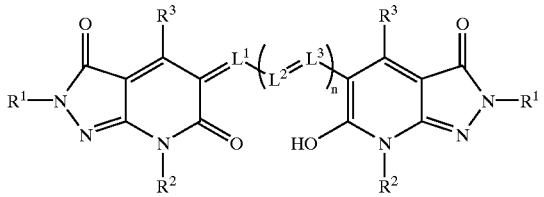

| | $R^1$ | $R^2$ | $R^3$ | $=L^1-(L^2=L^3)_n-$ |
|---|---|---|---|---|
| IV-51 | $-CH_3$ | 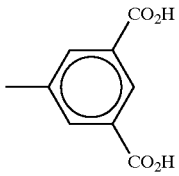 | $-CH_3$ | $=-CH=CH-CH=CH-$ |

The dyes for use in the present invention can be synthesized by the same or nearly the same methods as those described in International Patent WO88/04794; European Patent Application Laid-Open Nos. EPO274,723A1, 276, 566, and 299,435; JP-A Nos. 52-92716, 55-155350, 55-155351, 61-205934, and 48-68623; U.S. Pat. Nos. 2,527, 583, 3,486,897, 3,746,539, 3,933,798, 4,130,429, and 4,040, 841; and JP-A Nos. 3-282244, 3-7931, and 3-167546.

The dispersion of solid particles of a dye for use in the present invention can be prepared in a conventionally known way. The details of the process for the preparation are described in, for example, "Application Technologies of Functional Pigments" (Kinoosei Ganryo Ooyo Gijutsu) (CMC, 1991).

Dispersing by use of media is one of the common methods. According to this method, a dye powder or a so-called wet cake of a dye which has been prepared by wetting the dye with water or an organic solvent, is converted into aqueous slurry. The slurry is mechanically ground by a known pulverizing means (e.g., ball mill, vibration ball mill, planetary ball mill, vertical sand mill, roller mill, pin mill, cobble mill, caddy mill, horizontal sand mill, attritor, and the like) in the presence of dispersing media (steel balls, ceramic balls, glass beads, alumina beads, zirconia silicate beads, zirconia beads, Ottawa sand, and the like). The average diameter of the beads is preferably 2 to 0.3 mm, more preferably 1 to 0.3 mm, and further preferably 0.5 to 0.3 mm. Examples of other grinding methods that can be used include methods using a jet mill, roll mill, homogenizer, colloid mill, or dissolver as well as a grinding method using an ultrasonic dispersing machine.

Further examples of methods that can be used include a method in which, after the formation of a homogeneous solution of a dye, solid particles are deposited by the addition of a poor solvent as described in U.S. Pat. No. 2,870,012; and a method in which, after a dye is dissolved in an alkaline solution, solid particles are deposited by lowering the pH of the solution.

When these dispersions of solid particles are prepared, the presence of a dispersing aid is preferable. Examples of the dispersing aids disclosed hitherto include anionic dispersants such as alkylphenoxyethoxysulfonates, alkylbenzenesulfonates, alkylnaphthalenesulfonates, alkyl sulfate ester salts, alkylsulfosuccinates, sodium oleylmethyltauride, naphthalenesulfonic acid/formaldehyde condensation products, polyacrylic acid, polymethacrylic acid, maleic acid/acrylic acid copolymers, carboxymethylcellulose, and cellulose sulfate, nonionic dispersants such as polyoxyethylene alkyl ethers, fatty acid esters of sorbitan, and fatty acid esters of polyoxyethylenesorbitan, cationic dispersants, and betaine-based dispersants. However, the use of the polyalkylene oxide represented by the following general formula [V-a] or [V-b] is particularly preferable.

General formula [V-a]

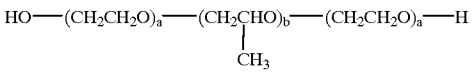

General formula [V-b]

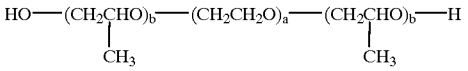

In the general formulae [V-a] and [V-b], a and b are each 5 to 500. Preferably, a and b are each 10 to 200; and more preferably a and b are each 50 to 150. It is preferable that a and b are each within the range described above because the uniformity of the surface of the coating layer becomes better if a and b are each within this range.

In the dispersing aid described above, the ratio of the polyethylene oxide portion by weight is preferably 0.3 to 0.9, more preferably 0.7 to 0.9, and further preferably 0.8 to 0.9. The average molecular weight of the dispersing aid described above is preferably 1,000 to 30,000, more preferably 5,000 to 40,000, and further preferably 8,000 to 20,000. The HLB (hydrophilicity/lipophilicity balance) of the dispersing aid described above is preferably 7 to 30, more preferably 12 to 30, and further preferably 18 to 30. It is preferable that these values are each within the respective ranges described above because the uniformity of the surface of the coating layer becomes better if these values are each within the respective ranges.

These compounds are commercially obtainable. For example, commercial products include Pluronic and the like manufactured by BASF Corp.

Specific examples (V-1 to V-23) of the compounds represented by the general formula [V-a] or [V-b] are given below.

TABLE 2

| No. | Weight Ratio of Polyethylene Oxide | Average Molecular Weight | HLB |
|---|---|---|---|
| General formula [V-a] | | | |
| V-1 | 0.5 | 1900 | ≧18 |
| V-2 | 0.8 | 4700 | ≧20 |
| V-3 | 0.3 | 1850 | 7–12 |
| V-4 | 0.4 | 2200 | 12–18 |
| V-5 | 0.4 | 2900 | 12–18 |
| V-6 | 0.5 | 3400 | 12–18 |
| V-7 | 0.8 | 8400 | ≧20 |
| V-8 | 0.7 | 6600 | ≧20 |
| V-9 | 0.4 | 4200 | 12–18 |
| V-10 | 0.5 | 4600 | 12–18 |
| V-11 | 0.7 | 7700 | ≧20 |
| V-12 | 0.8 | 11400 | ≧20 |
| V-13 | 0.8 | 13000 | ≧20 |
| V-14 | 0.3 | 4950 | 7–12 |
| V-15 | 0.4 | 5900 | 12–18 |
| V-16 | 0.5 | 6500 | 12–18 |
| V-17 | 0.8 | 14600 | ≧20 |
| V-18 | 0.3 | 5750 | 7–12 |
| V-19 | 0.7 | 12600 | ≧18 |
| General formula [V-b] | | | |
| V-20 | 0.5 | 1950 | 12–18 |
| V-21 | 0.4 | 2650 | 7–12 |
| V-22 | 0.4 | 3600 | 7–12 |
| V-23 | 0.8 | 8600 | 12–18 |

In the present invention, the weight ratio of the dispersing aid to be used to the dye is preferably 0.05 to 0.5 and more preferably 0.1 to 0.3. It is preferable that the amount to be used of the dispersing aid is within this range because the uniformity of the surface of the coating layer becomes better if the amount to be used of the dispersing aid is within this range.

In addition, when a dispersion of solid particles is prepared, in order to stabilize the dispersion or in order to reduce the viscosity of the dispersion, a hydrophilic colloid of such material as polyvinyl alcohol, polyvinyl pyrrolidone, polyethylene glycol, polysaccharide, or gelatin may be present. In the present invention, it is particularly preferable that the compound represented by the general formula [VI] described later is present.

It is preferable that the dispersion of solid particles of a dye is subjected to a heat treatment according to a method, for example, described in JP-A No. 5-216166 before, during, or after the dispersing operation.

It is preferable that the dye is subjected to a heat treatment at or above 40° C. before the dye is incorporated into the photosensitive material. Examples of the heat treatment include a method in which a dye powder is heated in a solvent before the step of forming a dispersion of solid particles of the dye, a method in which a dye is dispersed in water or other solvent in the presence of a dispersing aid wherein cooling is not carried out or heating is carried out, and a method in which a liquid obtained by dispersing a dye or a coating liquid after the dispersing operation is subjected to a heat treatment. Among these methods, a method in which a dye after being dispersed is subjected to a heat treatment is particularly preferable.

Where a plurality of the dispersions of solid particles of the dyes represented by the general formula [I] are used in a specific layer, heat treatment of at least one of the dispersions is enough.

The pH value during the dispersing operation and the heat treatment after the dispersing operation is not particularly limited in so far as the dispersion is stable. The pH is preferably 2.0 to 8.0, more preferably 2.0 to 6.5, and further preferably 2.5 or greater and less than 4.5. It is preferable that the pH during the heat treatment is within this range because the film strength of the coated layer is improved if the pH is within this range.

For the purpose of adjusting the pH of the dispersion, for example, sulfuric acid, hydrochloric acid, acetic acid, citric acid, phosphoric acid, oxalic acid, carbonic acid, sodium hydrogencarbonate, sodium carbonate, sodium hydroxide, potassium hydroxide, or a buffer solution prepared therefrom can be used.

The temperature for the heat treatment varies depending on the step in which the heat treatment is carried out, size and shape of the powder or particles, heat treatment condition, solvent, and the like. Therefore the temperature cannot be specified unqualifiedly and any temperature may be used if the temperature is not lower than 40° C. and the dye is not decomposed at that temperature. If the dye is heat-treated as a powder, the temperature is suitably 40 to 200° C. and preferably 90 to 150° C. If the dye is heat-treated in a solvent, the temperature is suitably 40 to 150° C. and preferably 90 to 150° C. If the dye is heat-treated during a dispersing operation, the temperature is suitably 40 to 90° C. and preferably 50 to 90° C. If a dispersion after the dispersing operation is heat-treated, the temperature is suitably 40 to 100° C. and preferably 50 to 95° C. If the temperature for the heat treatment is lower than 40° C., the effect is insufficient.

Where the heat treatment is carried out in a solvent, the solvent is not limited in so far as the solvent does not substantially dissolve the dye. Examples of the solvent include water, alcohols (e.g., methanol, ethanol, isopropyl alcohol, butanol, isoamyl alcohol, octanol, ethylene glycol, diethylene glycol, and ethyl cellosolve), ketones (e.g., acetone and methyl ethyl ketone), esters (e.g., methyl acetate and butyl acetate), alkylcarboxylic acids (e.g., acetic acid and propionic acid), nitriles (e.g., acetonitrile), ethers (e.g., dimethoxyethane, dioxane, and tetrahydrofuran), and amides (e.g., dimethylformamide).

Even if a dye is soluble in a solvent when used alone, the solvent can be used if the dye is substantially insoluble in a mixture of the solvent with other solvent or if the dye becomes insoluble in the solvent by controlling pH.

The time period of the heat treatment cannot be specified unqualifiedly, and a longer time is required if the treating temperature is low, whereas the time required is shorter if the treating temperature is high. Although the time period can be set at will within a range which does not affect the manufacturing process, preferred time period is normally 1 hour to 4 days.

For the purpose of forming a layer comprising particles of a dye in a photographic photosensitive material, a dispersion, which comprises approximately homogeneously dispersed solid particles prepared by dispersing the particles thus obtained in a suitable binder, is coated on a desired support.

The binder is not particularly limited if the binder is a hydrophilic colloid usable in a photosensitive emulsion layer or in a non-photosensitive layer. Normally, gelatin or a synthetic polymer such as polyvinyl alcohol or polyacrylamide is used as the binder.

The average particle diameter of the particles in the dispersion of solid particles is 0.005 to 10 μm, preferably 0.01 to 1 μm, and further preferably 0.01 to 0.7 μm. If the average particle diameter is within this range, advantageous properties of the particles in terms of non-coagulation and light absorption efficiency are obtained.

The dispersions of, solid particles of a dye represented by the general formula [I] can be used singly or in combinations of a plurality of the dispersions of solid particles.

The dispersion of solid particles may be added to a single hydrophilic colloid layer or may be added to a plurality of the hydrophilic colloid layers. For example, a single dispersion of solid particles is added to a single hydrophilic colloid layer; aliquots of a dispersion of solid particles are added to a plurality of the layers; a plurality of dispersions of solid particles are added to a single layer simultaneously; or a plurality of dispersions of solid particles are added to different layers. These examples should not be construed as limitative.

In addition to incorporating an amount of the dispersion of solid particles required for an antihalation layer, the dispersion of solid particles in an amount required for the prevention of irradiation can also be incorporated into a photosensitive silver halide emulsion layer.

The hydrophilic colloid layer containing the dispersion of solid particles of the dye represented by the general formula [I] is formed between the support and a silver halide emulsion layer closest to the support. In this case, a non-photosensitive hydrophilic colloid layer other than the hydrophilic colloid layer containing the dispersion of solid particles may be present between the support and a silver halide emulsion layer closest to the support.

In a silver halide photographic photosensitive material, the dispersion of solid particles of a dye is incorporated in a non-photosensitive hydrophilic colloid layer in accordance with the hue of the dye. In a photosensitive material of the aspect having a plurality of non-photosensitive layers formed, the dispersion of solid particles of the dye may also be incorporated in the plurality of these layers.

The dye concentration in the dispersion of solid particles is suitably 0.1 to 50 weight %, preferably 2 to 35 weight %, more preferably 2 to 30 weight %, and particularly preferable is 2 to 25 weight %. If the dye concentration is within this range, advantageous viscosities of the dispersion are obtained. The preferred coating weight of the dispersion of solid particles is about 0.05 to 0.5 g/m$^2$.

In the present invention, it is preferable that a compound represented by the general formula [VI] is contained together with the dispersion of solid particles in the same photographic constituent layer.

General formula [VI]

$$P—((S)_m—R)_n$$

In the general formula [VI], R represents a hydrogen atom, a hydrophobic group, or a hydrophobic polymer. P represents a polymer which contains at least one of the following units A, B, and C, and has a degree of polymerization not less than 10 and not more than 35000. n represents 1 or 2. m represents 1 or 0.

A

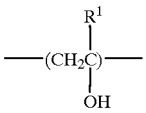

-continued

B

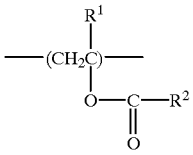

C

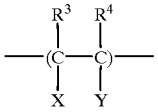

In the formulae described above, $R^1$ represents —H or an alkyl group having 1 to 6 carbon atoms. $R^2$ represents —H or an alkyl group having 1 to 10 carbon atoms. $R^3$ represents —H or —$CH_3$. $R^4$ represents —H, —$CH_3$, —$CH_2COOH$ (including an ammonium salt or a metal salt), or —CN. X represents —H, —COOH (including an ammonium salt or a metal salt), or —$CONH_2$. Y represents —COOH (including an ammonium salt or a metal salt), —$SO_3H$ (including an ammonium salt or a metal salt), —$OSO_3H$ (including an ammonium salt or a metal salt), —$CH_2SO_3H$ (including an ammonium salt or a metal salt), —$CONHC(CH_3)_2CH_2SO_3H$ (including an ammonium salt or a metal salt), or —$CONHCH_2CH_2CH_2N^+(CH_3)_3Cl^-$.

Details (specific descriptions, preferred limitation, exemplary compounds, amounts to be used, methods for synthesis, etc.) of the compounds represented by the general formula [VI] are described in JP-A No. 11-95371, page 24, column 46, lines 27, to page 33, column 63, lines 2 (paragraphs 0090 to 0128) and are incorporated into part of the specification of the present invention.

The silver halide color photographic photosensitive material of the present invention is processed according to a conventionally employed processing method.

Particularly in the processing of the silver halide color photographic photosensitive material for cinema, the positive-type photosensitive material for cinema can be processed according to the following processing steps hitherto employed. In the case of the positive-type photosensitive material for cinema of the present invention, the steps of (1) pre-bath and (2) water rinse bath for removal of the resin back layer can be eliminated. Such processing, in which the number of the steps is reduced, is desirable from the viewpoint of the simplification of the processing.

In the case where sound tracks are formed by dye images, the steps of (6) the first fixing bath, (7) water rinse bath, (11) sound developing bath, and (12) water rinse can be eliminated. Therefore, this an aspect which is very desirable in terms of simplification of the processing. The silver halide photosensitive material of the present invention exhibits excellent performances also in such processing.

Conventionally employed standard processing steps (excluding a drying step) of a positive-type photosensitive material for cinema (1) pre-bath
(2) water rinse bath
(3) color-developing bath
(4) stop bath
(5) water rinse bath
(6) first fixing bath
(7) water rinse bath
(8) bleach-accelerating bath
(9) bleaching bath
(10) water rinse bath

(11) sound developing bath (development by coating)
(12) water rinse
(13) second fixing bath
(14) water rinse bath
(15) stabilizing bath In the present invention, among the steps described above, where the color development (i.e., the step (3)) time is not more than 2 minutes and 30 seconds (the minimum is preferably 6 seconds or more, more preferably 10 seconds or more, further preferably 20 seconds or more, and most preferably 30 seconds or more), and more preferably not more than 2 minutes (the minimum is the same as in the time period of 2 minutes and 30 seconds), the effect of the present invention is remarkable and therefore such time periods are preferable.

Next, photographic layers etc. of the silver halide color photographic photosensitive material of the present invention is described.

The silver halide color photographic photosensitive material of the present invention can be used as an ordinary color photosensitive material and as a color photosensitive material for cinema such as a color negative film, a color negative film for cinema, a color positive film, and a color positive film for cinema.

As a typical example, the silver halide color photographic photosensitive material of the present invention is a silver halide color photographic photosensitive material comprising a transparent support having thereon at least one photosensitive layer composed of a plurality of silver halide emulsion layers having substantially different color sensitivities.

In the present invention, the number and order of the photosensitive silver halide emulsion layers and the non-photosensitive hydrophilic colloid layers are not particularly limited. The yellow-, cyan-, and magenta-developing photosensitive silver halide emulsion layers may each be made up of one photosensitive silver halide emulsion layer or may each be made up of a plurality of silver halide emulsion layers sensitive to the same color but having different sensitivities.

Color developability and color sensitivity of each of the color-developing photosensitive silver halide emulsion layers are not limited. For example, a color-developing photosensitive silver halide emulsion layer may have a color sensitivity in an infrared region.

A typical order of the layers listed from the support is a non-photosensitive hydrophilic colloid layer containing a dispersion of solid particles of a dye of the present invention, a yellow-developing photosensitive silver halide emulsion layer, a non-photosensitive hydrophilic colloid layer (i.e., a layer for the prevention of color mixing), a cyan-developing photosensitive silver halide emulsion layer, a non-photosensitive hydrophilic colloid layer (i.e., a layer for the prevention of color mixing), a magenta-developing photosensitive silver halide emulsion layer, and a non-photosensitive hydrophilic colloid layer (i.e., a protective layer). However, depending on purposes, the order of the layers may be altered, or the number of the photosensitive silver halide emulsion layers or the number of the non-photosensitive hydrophilic colloid-layers may be increased or decreased.

The silver halide grains to be used in the present invention include silver chloride, silver bromide, silver (iodo) chlorobromide, silver iodobromide, and the like. In particular, in order to shorten the time required for development processing in the present invention, silver chloride, silver chlorobromide, silver chloroiodide, and silver chloroiodobromide, each having a silver chloride content of 95 mol % or greater, can be preferably used in the present invention. The shape of the silver halide grain in the emulsion may be selected from a regularly structured crystal such as a cube, octahedron, or tetradecahedron, an irregularly structured crystal such as a sphere and a tabular shape, a crystal having a crystal defect such as twin planes, and a complex made up of the foregoing. The use of a tabular grain whose main plane is a (111) surface or (100) surface is preferable in terms of speeding up of the color development and reduction of color mixing in the processing. The emulsions of tabular grains which have a (111) surface or (100) surface as a main plane and are rich in silver chloride can be prepared by the methods described in JP-A No. 6-138619, U.S. Pat. Nos. 4,399,215, 5,061,617, 5,320,938, 5,264,337, 5,292,632, 5,314,798, and 5,413,904, WO94/22051, and others.

Although a silver halide emulsion having any halogen composition may be used in the present invention, preferably the silver halide emulsion to be used is a silver chloride(iodide) emulsion or a silver chloro(iodo)bromide emulsion, each having a silver chloride content of 95 mol % or greater. More preferably, the silver halide emulsion to be used together is a silver halide emulsion having a silver chloride content of 98 mol % or greater like the silver halide emulsion of the present invention.

In the silver halide emulsion of the present invention, the shape of the silver halide grain may be selected from a regularly structured crystal such as a cube, octahedron, or tetradecahedron, a crystal having a crystal defect such as twin planes, and a complex made up of the foregoing.

As to the grain size of the silver halide, the grain diameter may be smaller than about 0.2 $\mu$m or the diameter of the projected area may be up to about 10 $\mu$m. The emulsion may be made up of a polydispersed grain system or may be made up of a monodispersed grain system. In the silver halide grains of the present invention, in order to quicken the process of development, a monodispersed grain system is preferable, and the variation coefficient of the grain sizes of the silver halide emulsions is preferably 0.3 or less (preferably 0.3 to 0.05), and more preferably 0.25 or less (preferably 0.25 to 0.05). The term "variation coefficient" as used herein means the ratio (s/d) where s is a statistical standard deviation and d is an average grain size.

The silver halide photographic emulsions usable in the present invention can be prepared by the methods described in, for example, Research Disclosure (hereinafter abbreviated as RD) No. 17643 (December, 1978), pp.22–23, "I. Emulsion preparation and types", No. 18716 (November, 1979), pp.648, and No. 307105 (November, 1989), pp.863–865; P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964.

Also preferable are monodispersed emulsions described in U.S. Pat. Nos. 3,574,628 and 3,655,394 and U. K. Patent No. 1,413,748.

Tabular grains having an aspect ratio of 3 or greater can also be used in the present invention. The tabular grains can be easily prepared by the methods described in Gutoff, Photographic Science and Engineering, vol. 14, 248–257 (1970), U.S. Pat. Nos. 4,434,226, 4,414,310, 4,433,048, and 4,439,520 and U. K. Patent No. 2,112,157.

The silver halide crystal structure may be uniform, may have interior halogen composition different from exterior halogen composition, or may have a different silver halide joined by an epitaxial junction. For example, the silver halide crystal structure may be joined by a compound other than a silver halide such as silver rhodanide, lead oxide, or the like. In addition, a mixture of various crystal shapes may be used.

Although the emulsion described above may be of a surface latent image type in which the latent image is formed mainly on the surface of grains, an interior latent image type in which the latent image is formed inside the grains, and a type in which the latent image is formed both on the surface and interior of grains, the emulsion needs to be of a negative type. Of the interior latent image types, an interior latent image type emulsion based on a core/shell structure described in JP-A No. 63-264740 may be used. The method of preparing the emulsion is described in JP-A No. 59-133542. The thickness of the shell of the emulsion is preferably 3 to 40 nm and more preferably 5 to 20 nm, although the thickness varies depending on the methods of development processing, etc.

Normally, the silver halide emulsion after undergoing physical ripening, chemical ripening, and spectral sensitization is used. The additives to be used in these steps are described in RD No. 17643, RD No. 18716, and RD No. 307105. The relevant references are summarized in the table below.

In the photosensitive material of the present invention, two or more photosensitive silver halide emulsions, in which at least one property selected from grain size, grain size distribution, halogen composition, shape of grain, and sensitivity is different, can be used as a blend to be incorporated in the same layer.

In the photosensitive material of the present invention, the coating weight of silver is preferably 6.0 g/m$^2$ or less, more preferably 4.5 g/m$^2$ or less, and most preferably 2.0 g/m$^2$ or less. Further, the coating weight to be used of silver is preferably 0.01 g/m$^2$ or more, more preferably 0.02 g/m$^2$ or more, and most preferably 0.5 g/m$^2$ or more.

It is preferable that any layer, preferably a silver halide emulsion layer, of the photographic constituent layers, made up of photosensitive silver halide emulsion layers, non-photosensitive hydrophilic colloid layers (such as interlayer and protective layer) formed on a support, contains preferably $1.0\times10^{-5}$ to $5.0\times10^{-2}$ mole, more preferably $1.0\times10^{-4}$ to $1.0\times10^{-2}$ mole, of a 1-aryl-5-mercaptotetrazole compound per mole of the silver halide. The incorporation of this compound in an amount falling within the above-described range makes it possible to further diminish the stains on the color photographs after undergoing continuous processing.

The 1-aryl-5-mercaptotetrazole compound is a compound in which the aryl group in the 1-position is an unsubstituted or substituted phenyl group. Preferred specific examples of the substituent include an acylamino group (e.g., acetylamino, —$NHCOC_5H_{11}$(n), or the like), a ureido group (e.g., methylureido), an alkoxy group (e.g., methoxy), a carboxyl group, an amino group, a sulfamoyl group, and so on. A plurality (e.g., 2 or 3) of these groups may be linked to the phenyl group. The position of these groups is preferably a meta- or para-position.

Examples thereof include 1-(m-methylureidophenyl)-5-mercaptotetrazole and 1-(m-acetylaminophenyl)-5-mercaptotetrazole.

The photographic additives usable in the present invention are described in the following Journals of Research Disclosure (RD). The following table shows the relevant references.

| Additives | RD17, 643 | RD18, 716 | RD307, 105 |
|---|---|---|---|
| 1. Chemical sensitizers | page 23 | page 648, right column | page 866 |
| 2. Sensitivity raising agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbers, filter dyes, ultraviolet absorbers | pages 25–26 | page 649, right column to page 650, right column | page 873 |
| 6. Binders | page 26 | page 651, left column | pages 873–874 |
| 7. Plasticizers, lubricants | page 27 | page 650, right column | page 876 |
| 8. Coating aids, surfactants | pages 26–27 | page 650, right column | pages 875–876 |
| 9. Antistatic agents | page 27 | page 650, right column | pages 876–877 |
| 10. Matting agents | | | pages 878–879 |

Although various dye-forming couplers can be used in the silver halide color photographic photosensitive material of the present invention, the following couplers are particularly preferable.

Yellow couplers (couplers usable in combination with the yellow couplers of the present invention): couplers represented by the formulae (I) and (II) in EP 502,424A; couplers (particularly Y-28 on page 18) represented by the formulae (1) and (2) in EP 513,496A; couplers represented by Formula (1) in claim 1 of EP 568,037A; couplers represented by the general formula (I) in column 1, lines 45 to 55, in U.S. Pat. No. 5,066,576; couplers represented by the general formula (I) in paragraph 0008 of JP-A-4-274425; couplers (particularly D-35 on page 18) described in claim 1 on page 40 in EP 498,381A1; couplers (particularly Y-1 (page 17) and Y-54 (page 41)) represented by the formula (Y) on page 4 in EP 447,969A1; and couplers (particularly II-17 and II-19 (column 17) and II-24(column 19)) represented by the formulae (II) to (IV) in column 7, lines 36–58, in U.S. Pat. No. 4,476,219.

Magenta couplers: JP-A-3-39737(L-57(page 11, lower right column), L-68 (page 12, lower right column), and L-77(page 13, lower right column)); A-4-63 (page 134) and A-4-73,-75 (page 139) in EP 456,257; M-4,-6 (page 26), and M-7(page 27) in EP 486,965; M-45 in paragraph 0024 of JP-A No. 6-43611; M-1 in paragraph 0036 of JP-A No.5-204106; and M-22 in paragraph 0237 of JP-A-4-362631.

Cyan couplers: CX-1, 3, 4, 5, 11, 12, 14, and 15 (pages 14 to 16) in JP-A-4-204843; C-7 and 10 (page 35), 34 and 35(page 37), and (I-1) and (I-17) (pages 42 and 43) in JP-A-4-43345; and couplers represented by the general formula (Ia) or (Ib) described in claim 1 of JP-A-6-67385.

Polymer couplers: P-1 and P-5 (page 11) in JP-A-2-44345.

Infrared couplers for the formation of sound tracks: couplers described in JP-A No. 63-143546 and couplers described in the patents cited in that patent application.

Couplers providing colored dyes having a proper diffusibility are preferably those described in U.S. Pat. No. 4,366,237, GB 2,125,570, EP 96,873B and DE 3,234,533.

Preferred couplers for correcting unnecessary absorption of colored dyes are yellow-colored cyan couplers (particularly YC-86 on page 84) represented by the formulae (CI), (CII), (III) and (CIV) described on page 5 in EP 456,257A1; yellow-colored magenta couplers ExM-7 (page 202), Ex-1 (page 249) and Ex-7 (page 251) in EP 456, 257A1; magenta-colored cyan couplers CC-9 (column 8) and CC-13 (column 10) described in U.S. Pat. No. 4,833, 069; and colorless masking couplers in (2) (column 8) of U.S. Pat. No. 4,837,136 and those represented by the formula [C-1] in claim 1 (particularly exemplary compounds on pages 36 to 45) of WO92/11,575.

Examples of a compound (including a coupler) which reacts with the oxidized form of a developing agent and releases a photographically useful compound residue are as follows. Development inhibitor-releasing compounds: compounds (particularly T-101 (page 30), T-104 (page 31), T-113 (page 36), T-131 (page 45), T-144 (page 51) and T-158 (page 58)) represented by the formulae (I), (II), (III) and (IV) described on page 11 in EP 378,236A1, compounds (particularly D-49 (page 51)) represented by the formula (I) described on page 7 in EP 436,938A2, compounds (particularly (23) in paragraph 0027) represented by the formula (1) in JP-A No. 5-307248, and compounds (particularly I-(1) on page 29) represented by the formulae (I), (II) and (III) described on pages 5 and 6 in EP 440, 195A2; bleach accelerator-releasing compounds: compounds (particularly (60) and (61) on page 61) represented by the formulae (I) and (I') described on page 5 in EP310, 125A2 and compounds (particularly (7) in paragraph 0022) represented by the formula (I) described in claim 1 of JP-A-6 -59411; ligand releasing-compounds: compounds (particularly compounds in column 12, lines 21 to 41) represented by LIG-X described in claim 1 of U.S. Pat. No. 4,555,478; leuco dye releasing-compounds: compounds 1 to 6 in columns 3 to 8 of U.S. Pat. No. 4,749,641; fluorescent dye releasing-compounds: compounds (particularly compounds 1 to 11 in columns 7 to 10) represented by COUP-DYE described in claim 1 of U.S. Pat. No. 4,774,181; development accelerators or fogging agent-releasing compounds: compounds (particularly compound (I-22) in column 25) represented by the formula (1), (2), or (3) described in column 3 of U.S. Pat. No. 4,656,123, and compounds represented by ExZK-2 described on page 75, lines 36 to 38, in EP 450,637A2; and compounds which release a group which does not function as a dye unless it splits off: compounds (particularly Y-1 to Y-19 in columns 25 to 36) represented by the formula (I) in claim 1 of U.S. Pat. No. 4,857,447.

Preferred additives other than couplers are as follows.

Dispersing media of oil-soluble organic compounds: P-3, 5, 16, 19, 25, 30, 42, 49, 54, 55, 66, 81, 85 and P-93 (pages 140 to 144) in JP-A-62-215272; impregnating latex of oil-soluble organic compounds: latex described in U.S. Pat. No. 4,199,363; scavengers of the oxidized forms of developing agents: compounds (particularly I-(1), (2), (6) and (12) (columns 4 and 5)) represented by the formula (I) in column 2, lines 54 to 62, in U.S. Pat. No. 4,978,606, and compounds (particularly compound 1 (column 3)) represented by the formulae in column 2, lines 5 to 10, in U.S. Pat. No. 4,923,787; stain inhibitors: formulae (I) to (III) on page 4, lines 30 to 33, particularly I-47, 72, III-1 and 27(pages 24 to 48) in EP 298,321A; browning inhibitors: A-6, 7, 20, 21, 23, 24, 25, 26, 30, 37, 40, 42, 48, 63, 90, 92, 94, and 164 (pages 69 to 118) in EP 298,321A, II-1 to III-23, particularly III-10, in columns 25 to 38 of U.S. Pat. No. 5,122,444, I-1 to III-4, particularly II-2, on pages 8 to 12 in EP 471,347A, and A-1 to A-48, particularly A-39 and A-42, in columns 32 to 40 of U.S. Pat. No. 5,139,931; materials which reduce the amount to be used of a coloration enhancer or a color-mixing inhibitor: I-1 to II-15, particularly I-46, on pages 5 to 24 in EP 411,324A; formalin scavengers: SCV-1 to SCV-28, particularly SCV-8, on pages 24 to 29 in EP 477,932A;

film hardeners: H-1, 4, 6, 8 and 14 on page 17 in JP-A-1-214845, compounds (H-1 to H-54) represented by the formulae (VII) to (XII) in columns 13 to 23 of U.S. Pat. No. 4,618,573, compounds (H-1 to H-76), particularly H-14, represented by the formula (6) on page 8, lower right column, in JP-A-2-214852, and compounds described in claim 1 of U.S. Pat. No. 3,325,287; precursors of development inhibitors: P-24, 37 and 39 (pages 6 and 7) in JP-A-62 -168139 and compounds described in claim 1, particularly 28~29, in column 7, of U.S. Pat. No. 5,019,492;

antiseptics and mildewproofing agents: I-1 to III-43, particularly II-1, 9, 10, 18 and III-25 in columns 3 to 15 of U.S. Pat. No. 4,923,790;

stabilizers and antifogging agents: I-1 to (14), particularly I-1, 60, (2) and (13), in columns 6 to 16 of U.S. Pat. No. 4,923,793, and compounds 1 to 65, particularly compound 36, in columns 25 to 32 of U.S. Pat. No. 4,952,483; chemical sensitizers: triphenylphosphine, selenides, and compound 50 described in JP-A-5-40324; dyes: a-1 to b-20, particularly a-1, 12, 18, 27, 35 and 36, and b-5 on pages 15 to 18, and V-1 to V-23, particularly V-1, on pages 27 to 29 in JP-A-3-156450, F-I-1 to F-II-43, particularly F-I-11 and F-II-8, on pages 33 to 55 in EP 445,627A, III-1 to III-36, particularly III-1 and III-3, on pages 17 to 28 in EP 457,153A, fine crystal dispersions of Dye-1 to Dye-124 on pages 8 to 26 in WO 88/04,794, compounds 1 to 22, particularly compound 1, on pages 6 to 11 in EP 319,999A, compounds D-1 to D-87 (pages 3 to 28) represented by the formulae (1) to (3) in EP 519,306A, compounds 1 to 22 (columns 3 to 10) represented by the formulas (I) in U.S. Pat. No. 4,268,622, and compounds (1) to (31) (columns 2 to 9) represented by the formulas (I) in U.S. Pat. No. 4,923,788; and UV absorbers: compounds (18b) to (18r) and 101 to 427 (pages 6 to 9) represented by the formula (1) in JP-A-46-3335, compounds (3) to (66) (pages 10 to 44) represented by the formula (I) and compounds HBT-1 to HBT-10 (page 14) represented by the formula (III) in EP 520,938A and compounds (1) to (31) (columns 2 to 9) represented by the formula (1) in EP 521,823A.

In the silver halide color photographic photosensitive material of the present invention, the total film thickness of all hydrophilic colloid layers on the side having the emulsion layers is preferably 28 μm or less, more preferably 23 μm or less, further preferably 18 μm or less, and particularly preferably 16 μm or less.

The total film thickness is preferably 0.1 μm or more, more preferably 1 μm or more, and further preferably 5 μm or more.

A film swell speed $T_{1/2}$ is preferably 60 seconds or less and more preferably 30 seconds or less. $T_{1/2}$ is defined as the time required until the film thickness reaches ½ of a saturation film thickness which is 90% of a maximum swell film thickness to be reached when processed by using a color developer at 30° C. for 3 minutes and 15 seconds. The film thickness means the thickness of a film measured in moisture conditioned to 55% relative humidity at 25° C. (two days). $T_{1/2}$ can be measured by using a swell meter described in A. Green et at., Photogr. Sci. Eng., vol. 19, No.2, pp.124–129. $T_{1/2}$ can be adjusted by adding a film hardening agent to gelatin as a binder or changing aging conditions after coating.

The swell ratio is preferably 180 to 280% and more preferably 200 to 250%.

The swell ratio is a measure indicating the equilibrium swell amount when the silver halide color photographic photosensitive material of the present invention is immersed in distilled water at 35° C. and caused to swell. The swell ratio is defined as:

Swell ratio (in %)=total film thickness when swelled/total film thickness when dried×100

The swell ratio can be controlled within the range described above by adjusting the amount to be added of the gelatin hardener.

The support is described below.

In the present invention, a transparent support is preferable, and a plastic support is more preferable.

Examples of the plastic support include films of polyethylene terephthalate, polyethylene naphthalate, cellulose triacetate, cellulose acetate butylate, cellulose acetate propionate, polycarbonate, polystyrene, and polyethylene.

Among these, polyethylene terephthalate is preferable, and a biaxially stretched and thermally fixed polyethylene terephthalate film is particularly preferable from the viewpoint of stability and toughness.

Although the thickness of the support is not particularly limited, it is generally 15 to 500 $\mu$m, preferably 40 to 200 $\mu$m in view of such advantage as ease in handling, and most preferably 85 to 150 $\mu$m.

A light-transmissive support means a support that transmits 90% or more of visible light. The light-transmissive support may contain dyed silicon, alumina sol, chromate, zirconate, or the like in an amount that does not substantially interfere with the transmission of light.

In order to adhere the photosensitive layers strongly to the surface of the plastic support, generally the support surface undergoes the following surface treatments. The support surface on which an antistatic layer (i.e., a back layer) is to be formed also generally undergoes the same surface treatments.

(1) a method in which a photographic emulsion (i.e., a coating liquid for forming a photosensitive layer) is applied onto the support surface after it has undergone a surface activation treatment such as a chemical treatment, a mechanical treatment, a corona discharge treatment, a flame treatment, an ultraviolet treatment, a high-frequency wave treatment, a glow discharge treatment, an active plasma treatment, a laser treatment, a mixed acid treatment, or an ozone oxygen treatment so that the adhesion is secured;

(2) a method in which a under coating layer is formed on the support surface which has undergone any of the surface activation treatments described above and thereafter a photographic emulsion is applied onto the undercoating layer.

Of the methods described above, the method (2) is more effective and is widely employed. Any of these methods is believed to enhance the adhesion by forming some polar groups on the inherently hydrophobic support surface; by removing a thin layer which will adversely affect the surface adhesion; and by increasing the surface cross-linkage density. As a result, the bonding strength between the under coating layer and the support surface is believed to improve due to increased affinity between the polar groups of the components contained in the under coating layer and the support surface and due to increased toughness of the bonded surface.

It is preferable that a non-photosensitive layer containing electroconductive metal oxide particles is formed on the plastic support surface on the side having no photosensitive layer.

An acrylic resin, a vinyl resin, a polyurethane resin, or a polyester resin is preferably used as a binder of the non-photosensitive layer. The non-photosensitive layer of the present invention is preferably hardened, and a compound based on aziridine, triazine, vinylsulfone, aldehyde, cyanoacrylate, peptide, epoxy, or melamine is used as the hardener. Among these hardeners, a melamine-based compound is particularly preferable from the standpoint of strongly immobilizing the electroconductive metal oxide particles.

Examples of the materials for electroconductive metal oxide particles include ZnO, $TiO_2$, $SnO_2$, $Al_2O_3$, $In_2O_3$, MgO, BaO, $MoO_3$, $V_2O_5$, complex oxides of the foregoing oxides, and metal oxides composed of the foregoing oxides and other atoms.

As the metal oxides, preferable are $SnO_2$, ZnO, $Al_2O_3$, $TiO_2$, $In_2O_3$, MgO, and $V_2O_5$; more preferable are $SnO_2$, ZnO, $Al_2O_3$, $In_2O_3$, $TiO_2$, and $V_2O_5$; and particularly preferable are $SnO_2$ and $V_2O_5$.

Examples of the oxide containing a small amount of a different element include ZnO doped with Al or In as a different element, $TiO_2$ doped with Nb or Ta as a different element, $In_2O_3$ doped with Sn as a different element, and $SnO_2$ doped with Sb, Nb, or a halogen element as a different element, wherein the amount of the different element to be added ranges from 0.01 to 30 mol %(preferably from 0.1 to 10 mol %). Sufficient electrical conductivity cannot be imparted to the oxide or complex oxide if the amount to be added of the different element is less than 0.1 mol %. On the other hand, if the amount to be added of the different element exceeds 30 mol %, the blackening of the particles becomes remarkable and the antistatic layer darkens to an extent that makes the photosensitive material unsuitable as such. Accordingly, it is preferable that the material for the electroconductive metal oxide particles contains a small amount of a different element to be added to the metal oxide or complex metal oxide. Also preferable as the material is a material containing an oxygen defect in the crystal structure.

The volume ratio of the electroconductive metal oxide particles to the entire non-photosensitive layer needs to be 50% or less and is preferably 3 to 30%. It is preferable that the amount of the electroconductive metal oxide particles is in accordance with the conditions described in JP-A No. 10-62905.

If the volume ratio exceeds 50%, dirt tends to adhere to the surface of the color photographs after being processed, whereas, if the volume ratio is less than 3%, a sufficient antistatic function cannot be exhibited.

Although a small particle diameter of the electroconductive metal oxide particle is preferable in view of minimizing the scattering of light, the particle diameter should be determined by using the ratio of the refractive indices between the particle and the binder as a parameter and can be determined based on Mie's theory. Generally, the average particle diameter is 0.001 to 0.5 $\mu$m and preferably 0.003 to 0.2 $\mu$m. The average particle diameter as used herein means an average particle diameter of particles including primary particles and particles having structures of higher orders of the electroconductive metal oxide particles.

When the above-mentioned metal oxide particles are added to the coating liquid for forming an antistatic layer, the particles may be added without prior treatment thereof. However, it is preferable that the particles are added in the form of a dispersion liquid prepared by dispersing the particles in a solvent such as water (containing a dispersant and a binder, if necessary).

The non-photosensitive layer preferably contains a hardened product composed of the binder as a binder which disperses and holds the electroconductive metal oxide particles and a hardener. In the present invention, it is preferable that both the binder and hardener are of a water-soluble type or in a state of an aqueous dispersion such as an emulsion, in view of maintaining a good working environment and preventing atmospheric pollution. In order to enable the binder to react with the hardener, the binder preferably has any one of the groups selected from a methylol group, a hydroxyl group, a carboxyl group, and a glycidyl group. A hydroxyl group and a carboxyl group are preferable, and a carboxyl group is particularly preferable. The content of the hydroxyl or carboxyl group in the binder is preferably 0.0001 to 1 equivalent/kg and particularly preferably 0.001 to 1 equivalent/kg.

The resins that are preferably used as the binder are explained below.

Examples of the acrylic resin include a homopolymer made up of a monomer selected from acrylic acid, acrylates such as alkyl acrylates, acrylamide, acrylonitrile, methacrylic acid, methacrylates such as alkyl methacrylates, methacrylamide, and methacrylonitrile; and a copolymer made up of two or more of these monomers. Among these polymers, a homopolymer made up of a monomer selected from acrylates such as alkyl acrylates and methacrylates such as alkyl methacrylates; or a copolymer made up of two or more of these monomers is preferable. Preferred examples include a homopolymer made up of a monomer selected from alkyl acrylates whose alkyl groups have 1 to 6 carbon atoms and alkyl methacrylates whose alkyl groups have 1 to 6 carbon atoms; and a copolymer made up of two or more of these monomers.

It is preferable that the acrylic resins described above are polymers which have the above-mentioned composition as main components and which are obtained by partly using a monomer having a group selected, for example, from a methylol group, a hydroxyl group, a carboxyl group, and a glycidyl group so that cross-linking reaction of the polymer with a hardener is possible.

Examples of the vinyl resin include polyvinyl alcohol, modified polyvinyl alcohol, polyvinyl formal, polyvinyl butyral, polyvinyl methyl ether, polyolefins, ethylene/butadiene copolymers, polyvinyl acetate, vinyl chloride/vinyl acetate copolymers, vinyl chloride/(meth)acrylate copolymers, and ethylene/vinyl acetate copolymers (preferably ethylene/vinyl acetate/(meth)acrylate copolymers). Among these vinyl resins, polyvinyl alcohol, modified polyvinyl alcohol, polyvinyl formal, polyolefins, ethylene/butadiene copolymers, ethylene/butadiene copolymers, and ethylene/vinyl acetate copolymers (preferably ethylene/vinyl acetate/(meth)acrylate copolymers) are preferable.

As to the vinyl resins, in order to enable a cross-linking reaction of the polymer with a hardener, in the case of polyvinyl alcohol, modified polyvinyl alcohol, polyvinyl formal, polyvinyl butyral, polyvinyl methyl ether, and polyvinyl acetate, the polymer is, for example, one which is made a hydroxy-bearing polymer by retaining polyvinyl alcohol units in the polymer, while in the case of other polymers, the polymer is one which is obtained by partly using a monomer having a group selected, for example, from a methylol group, a hydroxyl group, a carboxyl group, and a glycidyl group.

Examples of the polyurethane resins include polyurethanes derived from a compound or a mixture of compounds selected from a polyhydroxy compound (e.g., ethylene glycol, propylene glycol, glycerin, or trimethylolpropane), an aliphatic polyester-based polyol obtained by the reaction between the polyhydroxy compound and a polybasic acid, a polyether polyol (e.g., poly(oxypropylene ether)polyol or poly(oxyethylene/propylene ether)polyol), polycarbonate-based polyol, and polyethylene terephthalate polyol, and a polyisocyanate.

In the polyurethane resin described above, for example, the hydroxyl group, which remains unreacted after the reaction between the polyol and the polyisocyanate, can be utilized as a functional group capable of performing a cross-linking reaction with a hardener.

As the polyester resin described above, generally a polymer, which is obtained by the reaction between a polyhydroxy compound (e.g., ethylene glycol, propylene glycol, glycerin, or trimethylolpropane) and a polybasic acid, is used.

In the polyester resin described above, for example, the hydroxyl group and the carboxyl group, which remain unreacted after the completion of the reaction between the polyol and the polybasic acid, can be utilized as a functional group capable of performing a cross-linking reaction with a hardener. Needless to say, a third component having a functional group such as a hydroxyl group can be added.

Among the polymers, the acrylic resins and polyurethane resins are preferable and the acrylic resins are particularly preferable.

Examples of the melamine compound which is preferably used as the hardener include compounds having in the melamine molecule two or more (preferably three or more) methylol groups and/or alkoxy methyl groups, and melamine resins or melamine/urea resins as condensation polymerization products of these compounds.

Examples of the initial-stage condensation products of melamine and formalin include dimethylol melamine, trimethylol melamine, tetramethylol melamine, pentamethylol melamine, and hexamethylol melamine. Some specific nonlimiting examples of these products that are commercially available include Sumitex Resin M-3, MW, MK, and MC (manufactured by Sumitomo Chemical Co., Ltd.).

Examples of the condensation polymerization products include hexamethylol melamine resins, trimethylol melamine resins, and trimethyloltrimethoxymethyl melamine resins. Some specific nonlimiting examples of these products that are commercially available include MA-1 and MA-2 (manufactured by Sumitomo Bakelite Co., Ltd.), Beckamine APM and Beckamine J-101 (manufactured by Dainippon Ink & Chemicals Inc.), Uroid 344 (manufactured by Mitsui Toatsu Chemical Co., Ltd.), and Ohga Resin M31 and Ohga Resin PWP-8 (manufactured by Ohga Shinko Co., Ltd.).

Preferably, the functional group equivalent, which is a value obtained by dividing the molecular weight by the number of the functional groups within the molecule of the melamine compound, is not less than 50 and not more than 300. The functional group indicates a methylol group and/or an alkoxymethyl group. If the value exceeds 300, hardening density is small and a high strength cannot be obtained. The increase of the amount of the melamine compounds leads to inferior coatability. If the hardening density is small, scratch marks tend to occur. Further, if the hardening level is low, the power to hold the electroconductive metal oxide particles is reduced. On the other hand, if the functional group equivalent is less than 50, although the hardening density increases, the transparency is impaired and does not improve even if the amount of the melamine compound is decreased.

The amount to be added of the aqueous melamine compound is 1 to 100 weight %, preferably 10 to 90 weight %, based on the polymer described above.

If necessary, the antistatic layer may contain a matting agent, a surfactant, a slicking agent, and the like.

Examples of the matting agent include particles having a particle diameter of 0.001 to 10 μm of oxides, such as silicon oxide, aluminum oxide, and magnesium oxide, and polymers or copolymers such as polymethyl methacrylate and polystyrene.

Examples of the surfactant include conventionally known anionic surfactants, cationic surfactants, amphoteric surfactants, and nonionic surfactants.

Examples of the slicking agent include phosphoric esters of alcohols having 8 to 22 carbon atoms or amino salts thereof; palmitic acid, stearic acid, behenic acid, and esters thereof; and silicone-based compounds.

The thickness of the antistatic layer is preferably 0.01 to 1 μm and more preferably 0.01 to 0.2 μm. If the thickness is less than 0.01 μm, unevenness in coating tends to occur in the products due to difficulty in uniform coating of the coating liquids, whereas, if the thickness exceeds 1 μm, the antistatic property and scratch resistance may become inferior.

Preferably, a surface layer is formed on the antistatic layer. The surface layer is formed mainly for enhancement of the sliding property and scratch resistance and for aiding the antistatic layer in the function to prevent the separation of the electroconductive metal oxide particles.

Some illustrative nonlimiting examples of the material of the surface layer include: (1) waxes, resins, and rubbery substances composed of homopolymers or copolymers of 1-olefinic unsaturated hydrocarbons such as ethylene, propylene, 1-butene, and 4-methyl-1-pentene (e.g., polyethylene, polypropylene, poly-1-butene, poly-4-methyl-1-pentene, ethylene/propylene copolymers, ethylene/1-butene copolymers, and propylene/1-butene copolymers), (2) rubbery copolymers made up of two or more of the 1-olefins and conjugated or unconjugated dienes (e.g., ethylene/polyethylene/ethylidenenorbornene copolymers, ethylene/propylene/1,5-hexadiene copolymers, and isobutene/isoprene copolymers), (3) copolymers of 1-olefins with conjugated or unconjugated dienes (e.g., ethylene/butadiene copolymers and ethylene/ethylidenenorbornene copolymers), (4) copolymers of 1-olefins, ethylene in particular, with vinyl acetate and partial or complete saponification products thereof, and (5) graft copolymers prepared by grafting the above-mentioned conjugated or unconjugated dienes, vinyl acetate, or the like onto homopolymers or copolymers of 1-olefins and partial or complete saponification products thereof. These compounds are described in JP-B No. 5-41656.

Among these compounds, polyolefins, which have a carboxyl group and/or a carboxylate group, are preferable. These compounds are used normally as an aqueous solution or as an aqueous dispersion.

A water-soluble methylcellulose, whose methyl-substitution degree is 2.5 or less, may be added to the surface layer. The amount to be added of the water-soluble methylcellulose is preferably 0.1 to 40 weight % based on the total binder constituting the surface layer. This methylcellulose is described in JP-A No. 1-210947.

The surface layer can be formed by applying a coating liquid (i.e., an aqueous solution or an aqueous dispersion) containing the above-described binder, etc. onto the antistatic layer according to a conventionally well known method such as dip coating, air knife coating, curtain coating, wire bar coating, gravure coating, or extrusion coating.

The thickness of the surface layer is preferably 0.01 to 1 μm and more preferably 0.01 to 0.2 μm. If the thickness is less than 0.01 μm, unevenness in coating tends to occur in the products due to difficulty in uniform coating of the coating liquids, whereas, if the thickness exceeds 1 μm, the antistatic property and scratch resistance may become inferior.

The pH value of the coated film of the silver halide color photographic photosensitive material of the present invention is preferably 4.6 to 6.4 and more preferably 5.5 to 6.5. After the material is stored for a long period of time, if the pH value of the material exceeds 6.5, the cyan images and magenta images are much sensitized, whereas, if the pH value of the material falls below 4.5, the yellow image density largely varies depending on the intervals of time between the exposure of the photosensitive material and the processing thereof. Both phenomena present problems in terms of practical use.

The pH value of the coated film of the silver halide color photographic photosensitive material of the present invention is the pH value of the entire photographic layers obtained by applying the coating liquids onto a support and does not necessarily coincide with the pH of the coating liquids. The pH value of the coated film can be measured by the following method as described in JP-A No. 61-245153.

(1) 0.05 mL of pure water is dropped onto the surface of the photosensitive material on the side having the silver halide emulsion coated, and then (2) after the lapse of 3 minutes, the pH value of the coated film is measured by means of a surface pH measuring electrode (GS-165F manufactured by Towa Dempa Co., Ltd.). If necessary, the pH value of the coated film can be adjusted by using an acid (e.g., sulfuric acid, citric acid, or the like) or an alkali (e.g., sodium hydroxide or potassium hydroxide).

EXAMPLES

The present invention is more specifically explained by the following examples. However, it should be noted that the present invention is not limited to these examples.

Example 1

<Preparation of the Support>

An ethylene terephthalate film support (having a thickness of 120 μm) was prepared by applying layers onto an ethylene terephthalate film such that the surface to be coated with the emulsion was coated with a under coating layer and the surface opposite to the surface to be coated with the emulsion was coated with an acrylic layer containing the following electroconductive polymer (0.05 g/m$^2$) and tin oxide particles (0.20 g/m$^2$).

Electroconductive polymer

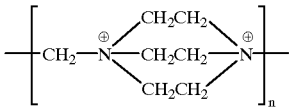

<Preparation of Dispersions of Solid Particles of a Dye>

A methanol-wetted cake of the exemplary dye (IV-1) in an amount equivalent to a net weight of 240 g, 48 g of the exemplary compound (V-12) as a dispersing aid, and water in an amount required to make 4000 g in total were used. These materials were charged into a "flow-type sand grinder mill" (UVM-2)" (manufactured by Imex Co. Ltd.) loaded with 1.7 L of zirconia beads (having a diameter of 0.5 mm) and ground for 2 hours at a flow rate of 0.5 L/min and a peripheral speed of 10 m/s. The dispersion obtained as a product was diluted with water so that the concentration of the compound became 3% by weight. After that, the following compound (Pm-1) was added in an amount equivalent to 3 weight % of the dye (the dispersion thus obtained was designated as the dispersion A) The average particle size of the dispersion was 0.45 μm.

In the same way as above, dispersions (A~I) of solid particles of dyes were prepared according to Table 3 by changing the dye and with or without the heat treatment after the preparation of the dispersion. Where the heat treatment was carried out, the compound (Pm-1) was added after the heat treatment.

TABLE 3

Dispersions of Solid Particles Used in the Examples

| Dispersions | Species of Dyes (Weight Ratio in the Case of a Mixture) | Heat Treatment (Temperature/Time) |
|---|---|---|
| A | IV-1 | Without Heat Treatment |
| B | Comparative Dye | Without Heat Treatment |
| C | Comparative Dye | 60° C.-5 d |
| D | IV-1 | 90° C.-10 h |
| E | IV-1 | 60° C.-5 d |
| F | IV-1/III-1(10/3) | 90° C.-10 h |
| G | IV-1/II-1(10/3) | 90° C.-10 h |
| H | IV-1/II-4(10/3) | 90° C.-10 h |
| I | III-5 | 90° C.-10 h |

Pm-1

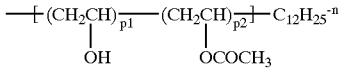

$P_1$ = 88 mol %
$P_2$ = 12 mol %
Degree of polymerization = 300
Comparative dye

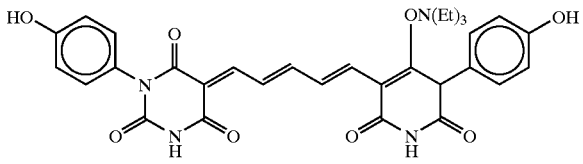

<Preparation of Sample 101>

Sample 101 as a multilayer color photosensitive material was prepared by coating the following layers having the following compositions on a support to thereby form a multilayer structure on the support. The coating liquids for forming the constituent photographic layers were prepared in the following ways.

<Preparation of the Coating Liquid for Forming the 2nd Layer>

104 g of a yellow coupler (ExY), 0.49 g of an additive (Cpd-4), 1.7 g of an additive (Cpd-5), and 0.27 g of an additive (Cpd-6) were dissolved in 25 g of a solvent (Solv-1) and 100 mL of ethyl acetate. The resulting solution was emulsified in 1000 g of a 10% gelatin aqueous solution containing 40 mL of a 10% sodium dodecylbenzenesulfonate to thereby prepare an emulsified dispersion Y.

Meanwhile, a silver chlorobromide emulsion B1 (cubic grains; a 1:5:4 (in silver molar ratio) blend composed of a large-size emulsion BL1 having an average grain size of 0.70 μm, a medium-size emulsion BM1 having an average grain size of 0.51 μm, and a small-size emulsion BS1 having an average grain size of 0.41 μm, having grain size distributions of 9%, 9%, and 8%, respectively, and each having a halogen composition Br/Cl=0.7/99.3) was prepared. This emulsion contained the following spectral sensitizing dye A in an amount of $3.5\times10^{-4}$ mol per mol of silver halide in the large-size emulsion BL1, in an amount of $4.6\times10^{-4}$ mol per mol of silver halide in the medium-size emulsion BM1, and in an amount of $5.3\times10^{-4}$ Mol per mol of silver halide in the small-size emulsion BS1; the following spectral sensitizing dye B in an amount of $2.4\times10^{-4}$ mol per mol of silver halide in the emulsion BL1, in an amount of $4.6\times10^{-4}$ mol per mol of silver halide in the emulsion BM1, and in an amount of $6.3\times10^{-4}$ mol per mol of silver halide in the emulsion BS1; and the following spectral sensitizing dye C in an amount of $1.8\times10^{-5}$ mol per mol of silver halide in the emulsion BL1, in an amount of $2.7\times10^{-5}$ mol per mol of silver halide in the emulsion BM1, and in an amount of $3.7\times10^{-4}$ mol per mol of silver halide in the emulsion BS1. The chemical sensitization of this emulsion was carried out to an optimum by the addition of a sulfur sensitizer and a gold sensitizer.

The coating liquid for forming the 2nd layer having the composition described later was prepared by blending the emulsified dispersion Y and the silver chlorobromide emulsion B1, and thereafter admixing the resulting blend with 0.001 g of an additive (Cpd-1), 0.06 g of an additive (Cpd-2), 0.31 g of an additive (Cpd-14), and 0.01 g of an additive (Cpd-15), said amounts of the additives being per gram of silver equivalent to the silver halide emulsion contained in the coating liquid. The coating weight of the emulsion indicates the weight equivalent to the weight of silver.

The liquids for the 1st to the 7th layers were prepared according to a method similar to the method for the preparation of the coating liquid for forming the 2nd layer. A 1-oxy-3,5-dicyclo-s-triazine sodium salt was used as the gelatin hardener for each layer.

The following spectral sensitizers were used in the silver chlorobromide emulsion for the photosensitive emulsion layers.

Blue-sensitive Emulsion Layer

Sensitizing dye A

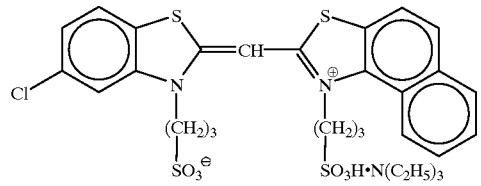

Sensitizing dye B

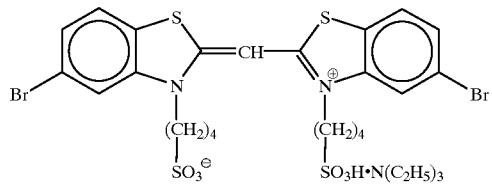

-continued

Sensitizing dye C

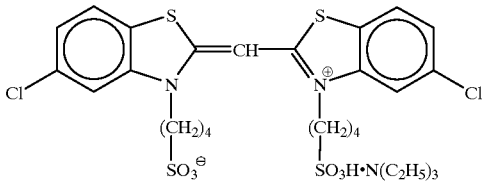

(The amounts to be used of these dyes were as described previously.)

Green-sensitive Emulsion Layer

Sensitizing dye D

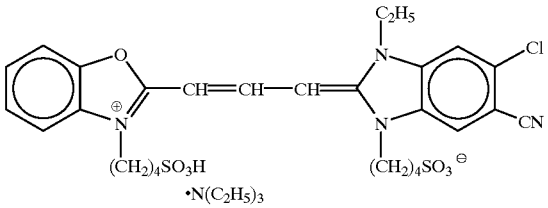

Sensitizing dye E

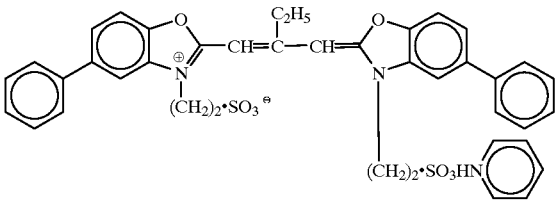

Sensitizing dye F

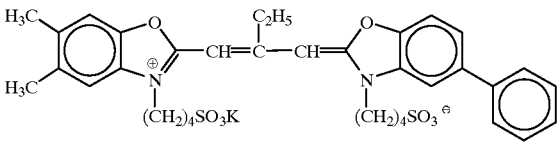

Sensitizing dye G

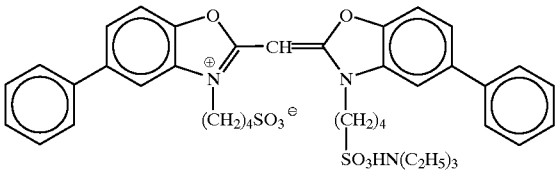

(The sensitizing dye D was used in an amount of $0.5\times10^{-4}$ mol per mol of silver halide to the large-size emulsion GL1, in an amount of $0.8\times10^{-4}$ mol per mol of silver halide to the medium-size emulsion GM1, and in an amount of $1.0\times10^{-4}$ Mol per mol of silver halide to the small-size emulsion GS1; the sensitizing dye E was used in an amount of $2.7\times10^{-4}$ mol per mol of silver halide to the emulsion GL1, in an amount of $3.8\times10^{-4}$ mol per mol of silver halide to the emulsion GM1, and in an amount of $5.0\times10^{-4}$ mol per mol of silver halide to the emulsion GS1; the sensitizing dye F was used in an amount of $0.1\times10^{-4}$ mol per mol of silver halide to the emulsion GL1, in an amount of $0.2\times10^{-4}$ mol per mol of silver halide to the emulsion GM1, and in an amount of $0.3\times10^{-4}$ mol per mol of silver halide to the emulsion GS1; and the sensitizing dye G was used in an amount of $0.3\times10^{-4}$ mol per mol of silver halide to the large-size emulsion GL1, in an amount of $0.4\times10^{-4}$ mol per mol of silver halide to the medium-size emulsion GM1, and in an amount of $0.5\times10^{-4}$ mol per mol of silver halide to the small-size emulsion GS1.)

Red-sensitive Emulsion Layer

Sensitizing dye H

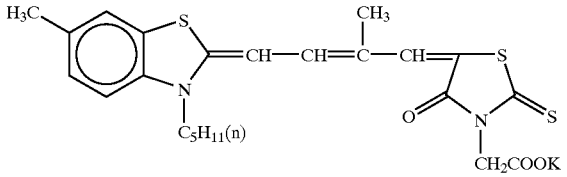

Sensitizing dye I

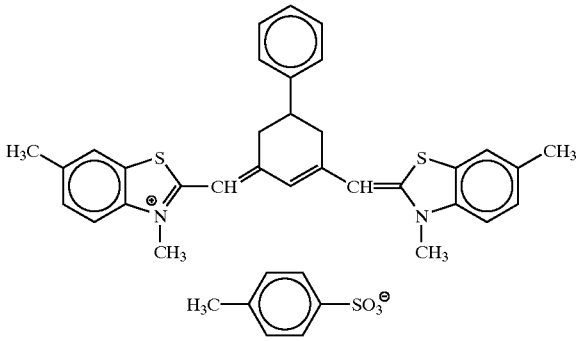

Sensitizing dye J

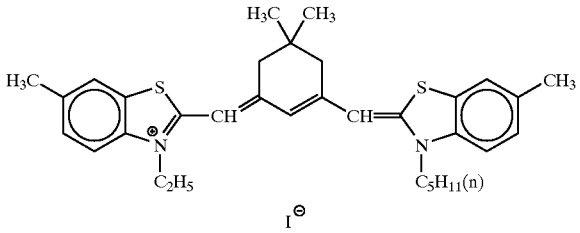

(The sensitizing dye H was used in an amount of $2.1\times10^{-5}$ mol per mol of silver halide to the large-size emulsion RL1, in an amount of $3.3\times10^{-5}$ mol per mol of silver halide to the medium-size emulsion RM1, and in an amount of $4.6\times10^{-5}$ mol per mol of silver halide to the small-size emulsion RS1; the sensitizing dye I was used in an amount of $1.5\times10^{-5}$ mol per mol of silver halide to the emulsion RL1, in an amount of $2.3\times10^{-5}$ mol per mol of silver halide to the emulsion RM1, and in an amount of $3.6\times10^{-5}$ mol per mol of silver halide to the emulsion RS1; and the sensitizing dye J was used in an amount of $0.8\times10^{-5}$ mol per mol of silver halide to the emulsion GL1, in an amount of $1.4\times10^{-5}$ mol per mol of silver halide to the emulsion GM1, and in an amount of $2.1\times10^{-5}$ mol per mol of silver halide to the emulsion RS1.)

Further, the following compound in an amount of $9.0\times10^{-4}$ mol per mol of silver halide was added to the red-sensitive emulsion layer.

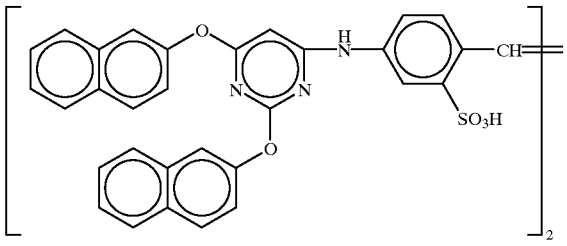

Furthermore, in order to prevent irradiation, the following dyes (the figure in the brackets indicates the coating weight) were added to the emulsion layer.

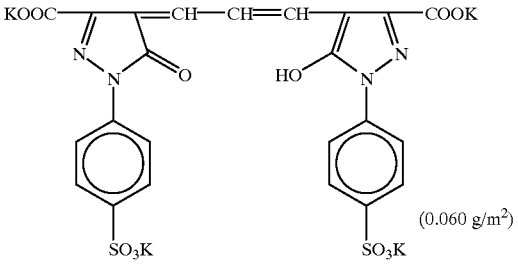

(0.060 g/m$^2$)

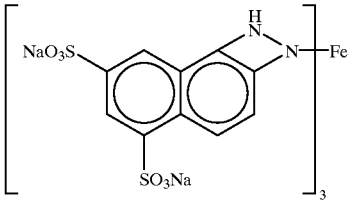

(0.105 g/m$^2$)

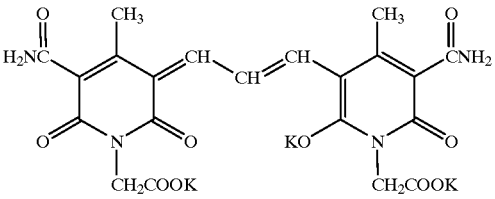

(0.018 g/m$^2$)

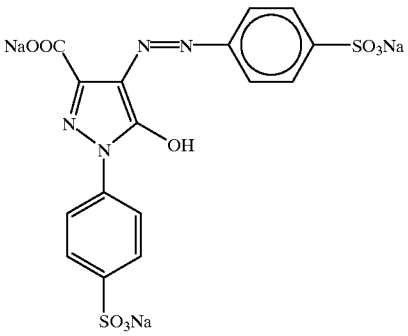

(0.010 g/m$^2$)

<Layer Construction>

The composition of each layer is given below. Each figure indicates a coating weight (g/m$^2$). The amount of the silver halide emulsion indicates the weight equivalent to the weight of silver.

Support

Polyethylene Terephthalate Film

| | |
|---|---|
| The 1st layer (antihalation layer) | |
| Gelatin | 0.68 |
| Dispersion A (dispersion of solid particles of a dye) | 0.11 |
| The 2nd layer (blue-sensitive emulsion layer) | |
| Silver chlorobromide emulsion B1 | 0.48 |
| Gelatin | 2.18 |
| Yellow coupler (ExY) | 1.18 |
| (Cpd-1) | 0.0006 |
| (Cpd-2) | 0.03 |
| (Cpd-4) | 0.006 |
| (Cpd-5) | 0.019 |
| (Cpd-6) | 0.003 |
| (Cpd-14) | 0.15 |
| (Cpd-15) | 0.005 |
| Solvent (Solv-1) | 0.28 |
| The 3d layer (layer for preventing color mixing) | |
| Gelatin | 0.42 |
| (Cpd-9) | 0.02 |
| (Cpd-3) | 0.04 |
| Solvent (Solv-1) | 0.05 |
| Solvent (Solv-3) | 0.04 |
| Solvent (Solv-4) | 0.001 |
| The 4th layer (red-sensitive emulsion layer) | |
| Silver chlorobromide emulsion R1 (cubic grains having an average halogen composition Br/Cl = 25 mol %/75 mol %, a 2:6:2 (in silver molar ratio) blend composed of a gold/sulfur-sensitized emulsion RL1 having an average grain size of 0.232 μm, an emulsion RM1 (the same as the emulsion RL1 except that the average grain size is 0.154 μm), and an emulsion RS1 (the same as the emulsion RL1 except that the average grain size is 0.121 μm) | 0.41 |
| Gelatin | 2.46 |
| Cyan coupler (ExC) | 0.74 |
| (Cpd-7) | 0.06 |
| (Cpd-8) | 0.05 |
| (Cpd-10) | 0.05 |
| (Cpd-13) | 0.02 |
| Solvent (Solv-1) | 0.50 |
| Solvent (Solv-2) | 0.28 |
| Solvent (Solv-3) | 0.02 |
| The 5th layer (layer for preventing color mixing) | |
| Gelatin | 0.42 |
| (Cpd-9) | 0.02 |
| (Cpd-3) | 0.02 |
| Solvent (Solv-1) | 0.05 |
| Solvent (Solv-3) | 0.04 |
| Solvent (Solv-4) | 0.001 |
| The 6th layer (green-sensitive emulsion layer) | |
| Silver chlorobromide emulsion G1 (cubic grains having an average halogen composition Br/C1 = 25 mol %/75 mol %, a 2:2:6 (in silver molar ratio) blend composed of a gold/sulfur-sensitized emulsion GL1 having an average grain size of 0.200 μm, an emulsion GM1 (the same as the emulsion GL1 except that the average grain size is 0.136 μm), and an emulsion GS1 (the same as the emulsion GL1 except that the average grain size is 0.102 μm) | 0.56 |
| Gelatin | 1.28 |
| Magenta coupler (ExM) | 0.68 |
| (Cpd-9) | 0.014 |
| (Cpd-11) | 0.001 |
| (Cpd-13) | 0.02 |
| Solvent (Solv-1) | 0.12 |
| The 7th layer (protective layer) | |
| Gelatin | 0.82 |
| Acryl-modified copolymer of polyvinyl alcohol (degree of modification: 17%) | 0.02 |
| (Cpd-12) | 0.04 |

The compounds used herein are shown below.
ExY
(1)
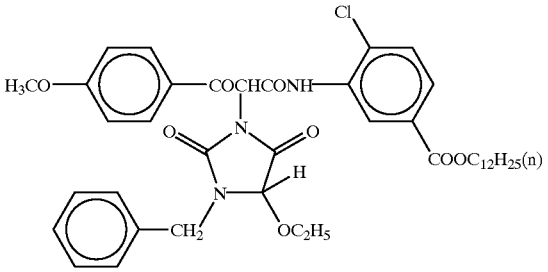
(2)
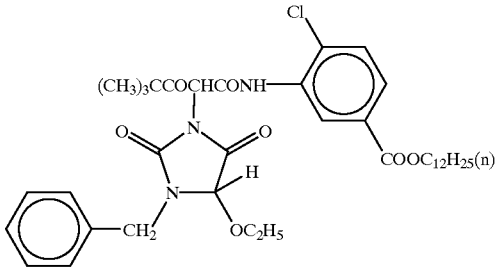
(3)
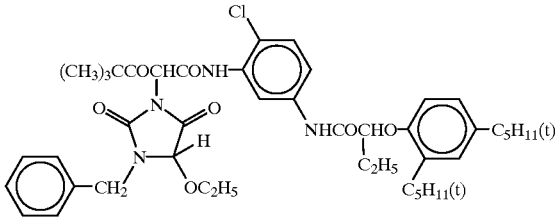
a 80:10:10 (in molar ratio) blend of (1), (2), and (3)
ExM
(1)
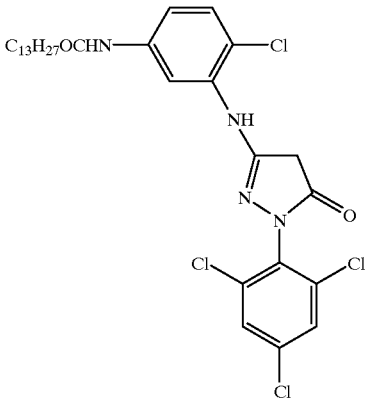
-continued
(2)
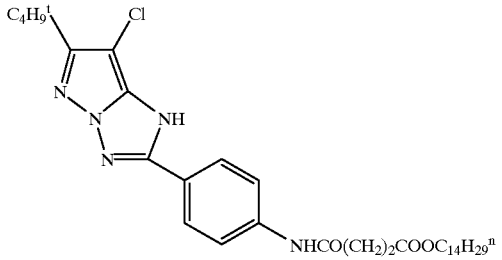
a 90:10 (in molar ratio) blend of (1) and (2)
ExC
(1)
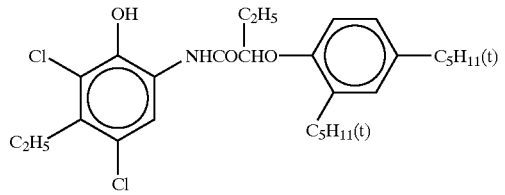
(2)
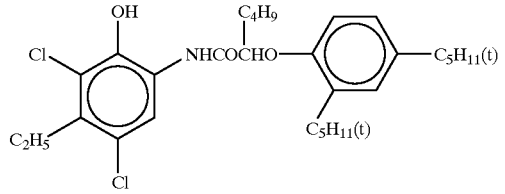
(3)
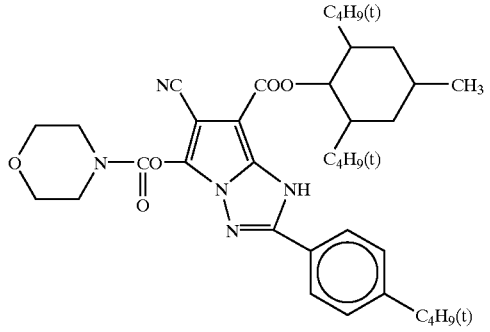
a 40:20:20 (in molar ratio) blend of (1), (2), and (3)
(Cpd-1)
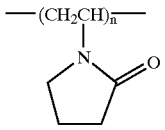
(Cpd-2)
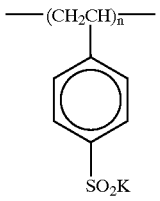

-continued
(Cpd-3)
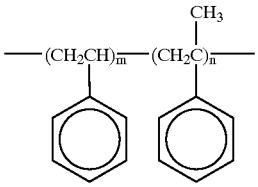
number average molecular weight = 600, m/n = 10/90
(Cpd-4)
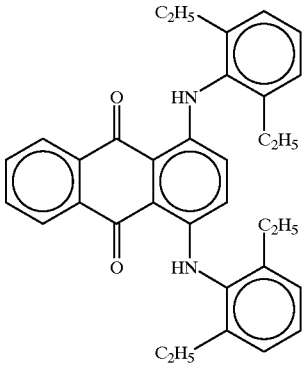
(Cpd-5)
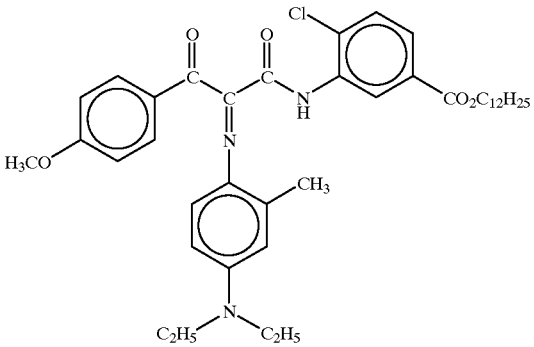
(Cpd-6)
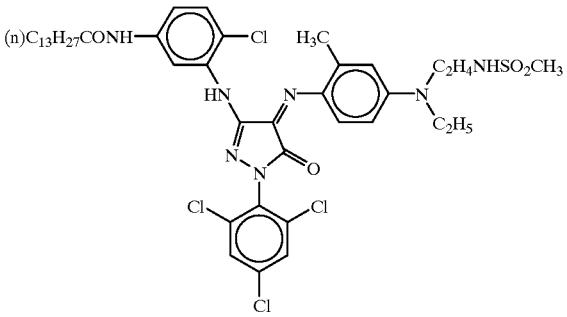
(Cpd-7)
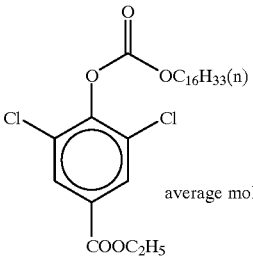
average molecular weight = about 600
-continued
(Cpd-8)
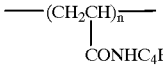
(Cpd-9)
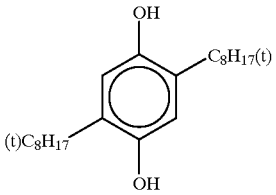
(Cpd-10)
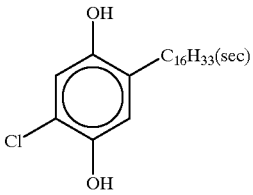
(Cpd-11)
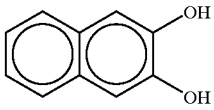
(Cpd-12)
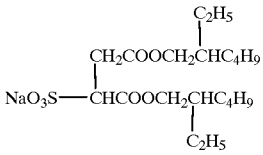
and
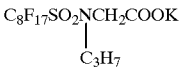
a 7:1 (in weight ratio) blend of these two compounds
(Cpd-13)
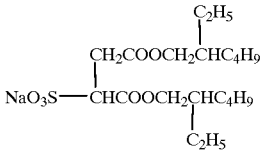
(Cpd-14)
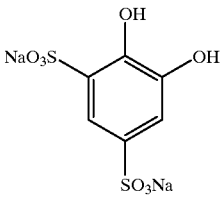
(Cpd-15)
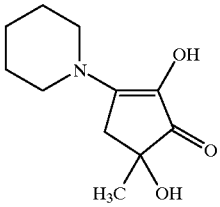

-continued (Solv-1)

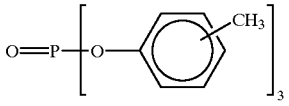

(Solv-2)

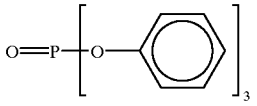

(Solv-3)

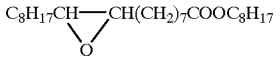

(Solv-4)

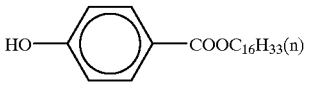

Preparation of Samples 102~127

Samples 102~127 were prepared as in the preparation of Sample 101, except that the kind of the dispersion of solid particles of a dye and the dye content used in the 1st layer of Sample 101 were changed; the yellow coupler used in the 2nd layer of Sample 101 was replaced by the yellow couplers of the present invention or by the following comparative couplers; and the weight ratio between the oil-soluble component and the hydrophilic colloid in the 2nd layer was changed.

The change in the dye content in the 1st layer was carried out by changing the coating weight of gelatin, while keeping the coating weight of the dye constant. The replacement of the coupler was carried out by replacing ExY of Sample 101 with an equimolar amount of other coupler. Likewise, the change in the weight ratio of the oil-soluble component and the hydrophilic colloid in the 2nd layer was carried out by changing the coating weight of gelatin. The details of the samples are shown in Table 4 together with assessment results.

Comparative coupler 1

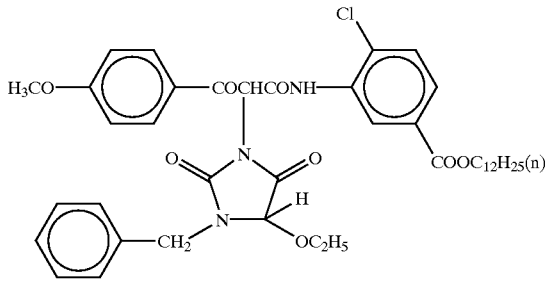

Comparative coupler 2

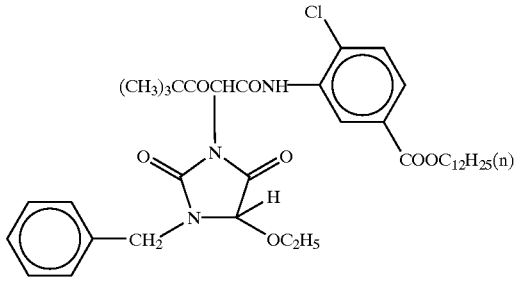

TABLE 4

Details of the Samples Used in Example 1 and Assessment Results

| Sample | Dispersion of solid particles of a dye | | Yellow | Weight ratio of the oil-soluble component and the hydrophilic | Density of developed | | Sharp-ness | Film strength | |
|---|---|---|---|---|---|---|---|---|---|
| Number | Kind | Content | Coupler | colloid in the 2nd layer | color | Hue | (c/mm) | (g) | Remarks |
| 101 | A | 16 | ExY | 0.68 | 1.00 | 0.16 | 33 | 140 | Comparative example |
| 102 | A | 16 | Comparative coupler 1 | 0.68 | 1.04 | 0.17 | 34 | 140 | Comparative example |
| 103 | A | 16 | Comparative coupler 2 | 0.65 | 0.83 | 0.13 | 30 | 140 | Comparative example |
| 104 | B | 16 | Comparative coupler 1 | 0.68 | 1.04 | 0.19 | 30 | 140 | Comparative example |
| 105 | D | 16 | Comparative coupler 1 | 0.68 | 1.05 | 0.17 | 35 | 140 | Comparative example |
| 106 | D | 16 | Comparative coupler 1 | 0.74 | 1.05 | 0.18 | 35 | 130 | Comparative example |
| 107 | D | 16 | Comparative coupler 1 | 0.78 | 1.06 | 0.18 | 36 | 90 | Comparative example |
| 108 | D | 16 | Comparative coupler 2 | 0.65 | 0.83 | 0.13 | 32 | 150 | Comparative example |
| 109 | A | 16 | (1) | 0.74 | 1.06 | 0.14 | 32 | 130 | Present example |
| 110 | B | 16 | (1) | 0.74 | 1.05 | 0.14 | 28 | 130 | Comparative example |
| 111 | C | 16 | (1) | 0.74 | 1.06 | 0.14 | 30 | 130 | Comparative example |
| 112 | D | 16 | (1) | 0.74 | 1.07 | 0.14 | 34 | 130 | Present example |
| 113 | E | 16 | (1) | 0.74 | 1.06 | 0.14 | 34 | 130 | Present example |
| 114 | F | 16 | (1) | 0.74 | 1.08 | 0.14 | 38 | 130 | Present example |
| 115 | G | 16 | (1) | 0.74 | 1.06 | 0.14 | 38 | 130 | Present example |
| 116 | H | 16 | (1) | 0.74 | 1.06 | 0.14 | 37 | 130 | Present example |
| 117 | I | 16 | (1) | 0.74 | 1.06 | 0.14 | 33 | 130 | Present example |
| 118 | D | 16 | (1) | 0.68 | 1.05 | 0.14 | 34 | 150 | Present example |
| 119 | D | 16 | (1) | 0.78 | 1.07 | 0.13 | 36 | <80 | Comparative example |
| 120 | D | 30 | (1) | 0.74 | 1.06 | 0.14 | 38 | 120 | Present example |

TABLE 4-continued

Details of the Samples Used in Example 1 and Assessment Results

| Sample Number | Dispersion of solid particles of a dye Kind | Content | Yellow Coupler | Weight ratio of the oil-soluble component and the hydrophilic colloid in the 2nd layer | Density of developed color | Hue | Sharpness (c/mm) | Film strength (g) | Remarks |
|---|---|---|---|---|---|---|---|---|---|
| 121 | D | 40 | (1) | 0.74 | 1.06 | 0.14 | 40 | 110 | Present example |
| 122 | D | 16 | (3) | 0.68 | 1.05 | 0.14 | 34 | 140 | Present example |
| 123 | D | 16 | (32) | 0.71 | 1.06 | 0.12 | 33 | 130 | Present example |
| 124 | G | 16 | (3) | 0.68 | 1.04 | 0.14 | 36 | 140 | Present example |
| 125 | G | 16 | (32) | 0.71 | 1.05 | 0.12 | 37 | 130 | Present example |
| 126 | H | 16 | (3) | 0.68 | 1.05 | 0.14 | 37 | 140 | Present example |
| 127 | H | 16 | (32) | 0.71 | 1.05 | 0.12 | 36 | 130 | Present example |

<Preparation of Processing Solutions>

As a standard method for processing a color positive film for cinema, ECP-2 Process disclosed by Eastman Kodak Co., Ltd., wherein the sound-developing step was eliminated, was prepared. Next, in order to produce a development processing state in a running equilibrium, all of the samples prepared were subjected to image-wise exposure which allowed about 30% of the coated silver to be developed, and continuous processing (running test) of the samples after the exposure was carried out until the replenished amount of the replenisher solution of the color developing bath reached twice the tank capacity.

ECP-2 Process (excluding the sound-developing step)
<Steps>

| Step | Processing temperature(0° C.) | Processing time(sec) | Replenished amount (mL based on 35 × 30.48 m) |
|---|---|---|---|
| 1. pre-bath | 27 ± 1 | 10 ~ 20 | 400 |
| 2. water-washing | 27 ± 1 | jet water washing | — |
| 3. developing | 36.7 ± 0.1 | 180 | 690 |
| 4. stopping | 27 ± 1 | 40 | 770 |
| 5. water-washing | 27 ± 3 | 40 | 1200 |
| 6. the 1st fixing | 27 ± 1 | 40 | 200 |
| 7. water-washing | 27 ± 3 | 40 | 1200 |
| 8. bleach-acceleration | 27 ± 1 | 20 | 200 |
| 9. bleaching | 27 ± 1 | 40 | 200 |
| 10. water-washing | 27 ± 1 | 40 | 1200 |
| 12. the 2nd fixing | 27 ± 1 | 40 | 200 |
| 13. water-washing | 27 ± 3 | 40 | 1200 |
| 14. rinsing | 27 ± 3 | 40 | 400 |
| 15. drying | | | |

Prescription of the processing solutions
Composition per liter

| Step | Names of chemicals | Tank solution | Replenisher solution |
|---|---|---|---|
| pre-bath | borax | 20 g | 20 g |
| | sodium sulfate | 100 g | 100 g |
| | sodium hydroxide | 1.0 g | 1.5 g |
| developing | Kodak Anti-calcium No. 4 | 1.0 mL | 1.4 mL |
| | sodium sulfite | 4.35 g | 4.50 g |
| | CD-2 | 2.95 g | 6.00 g |
| | sodium carbonate | 17.1 g | 18.0 g |
| | sodium bromide | 1.72 g | 1.60 g |
| | sodium hydroxide | — | 0.6 g |
| | sulfuric acid (7N) | 0.62 mL | — |
| stopping | sulfuric acid (7N) | 50 mL | 50 mL |
| fixing | (common to the 1st and 2nd) | | |
| | ammonium thiosulfate (58%) | 100 mL | 170 mL |
| | sodium thiosulfate | 2.5 g | 16.0 g |
| | sodium hydrogensulfite | 10.3 g | 5.8 g |
| | potassium bromide | 0.5 g | 0.7 g |
| bleach - acceleration | | | |
| | sodium metahydrogensulfite | 3.3 g | 5.6 g |
| | acetic acid | 5.0 mL | 7.0 mL |
| | PBA-1 (Kodak Persulfate Bleach Accelerator) | 3.3 g | 4.9 g |
| | EDTA-4Na | 0.5 g | 0.7 g |
| Bleaching | gelatin | 0.35 g | 0.50 g |
| | sodium persulfate | 33 g | 52 g |
| | sodium chloride | 15 g | 20 g |
| | sodium dihydrogen phosphate | 7.0 g | 10.0 g |
| | phosphoric acid (85%) | 2.5 ml | 2.5 ml |
| Rinse | Kodak Stabilizer Additive | 0.14 ml | 0.17 ml |
| | Dearcide 702 | 0.7 ml | 0.7 ml |

After being prepared, the samples were left at room temperature for 3 weeks and thereafter subjected to the following tests.

<Assessment of the Density of Developed Color>

The samples were subjected to sensitometry exposure through an optical wedge producing the difference in optical density of 0.2 per 5 mm using a sensitometer (model FWH, manufactured by Fuji Photo Film Co., Ltd.). After the exposure, the samples underwent color development processing in the processing solutions that had completed the running test described previously. Status A density of each sample thus processed was measured by means of X-rite 310 Densitometer and the values of the density were plotted versus logarithmic values of exposure amounts. In this way, a so-called sensitometry curve was produced.

In the assessment of the density of developed color, the densities observed at the maximum color development of these samples were compared and expressed in relative values by taking the density of Sample 101 as 1.00. The higher this value, the better is the color developing property.

In the assessment of hue, G densities in the region providing 1.0 of B density were assessed. The smaller this value is, the smaller the subsidiary absorption of yellow images and therefore color having high chroma is obtained.

<Assessment of Sharpness>

The samples were exposed to blue light through an optical wedge for CTF measurement. After the exposure, the samples underwent color development processing in the processing solutions that had completed the running test described previously. The samples thus processed underwent the measurement of CTF and the degree of sharpness was assessed by spatial frequency (cycles/mm) providing 0.8 of CTF. The higher this value, the higher is the degree of sharpness.

<Assessment of Film Strength>

The samples were exposed to uniform white light. After the exposure, the samples were immersed in a color developing solution. 30 seconds after the immersion, the surface of the coating of the samples was scratched with a sapphire needle whose end was in the shape of a sphere having a diameter of 0.8 mm by applying a load of 80 to 200 g with a stepwise increase by 10 g. The larger this value, the higher is the film strength.

Details of the samples and the assessment results are shown in Table 10.

<Assessment Results>

As can be seen from the results, the silver halide color photographic photosensitive material using the yellow coupler according to the present invention makes it possible to provide color having high chroma with slight subsidiary absorption of yellow images and having high density of developed color. It can also been seen that, if the dispersion of solid particles of a dye is used together, the above-mentioned effect becomes larger and samples producing images with superior sharpness can be obtained. However, as is the case with Sample 119, the samples having a higher ratio of the weight of hydrophilic colloid to the weight of oil-soluble component do not provide sufficient film strength. Therefore, in order to use the coupler of the present invention, this ratio needs to be within the range specified by the present invention.

Further, as can be seen from the comparison between the samples using the dispersion D or E like Sample 112 or 113 and the samples using the dispersion A like Sample 109, the heat treatment of the dispersions of solid particles of a dye provides better results.

Furthermore, the comparison between Sample 120, Sample 121, and Sample 112 makes it clear that the dye content in the dispersions of solid particles of a dye also contributes to the film strength.

Example 2

Emulsions were prepared as in Example 1, except that only the halogen composition was changed to Cl/Br=99.5/0.5 at the time of grain formation of the silver halide emulsions R1 and G1 for use in the 4th layer and the 6th layer. These emulsions were admixed with sensitizing dyes in amount equal to those of emulsions R1 and G1 and the chemical ripening was carried out to an optimum by the addition of the sulfur sensitizer and gold sensitizer. By replacing emulsions R1 and G1 of Samples 101~127 with these emulsions, Samples 201~227 were prepared. Samples 201~227 underwent the same treatments as in Example 1 and were subjected to the same assessment. The same assessment results were obtained. Accordingly, it can be said that the present invention is effective in a silver halide photographic photosensitive material using silver halide emulsion having a higher content of silver chloride.

Example 3

The condition and the prescription of the processing solution for the developing step in the processing of Example 1 were changed as follows. Further, the 6th and 7th steps (i.e., the 1st fixing and subsequent water-washing) were eliminated from the processing of Example 1. By using the above-described condition and processing solution, the densities of developed color and hues of Samples 201~227 prepared in Example 2 were assessed. Further, in order to see whether the unnecessary dye was completely removed or not, the cyan density in unexposed portions after processing was measured. The smaller the cyan density, the higher is the suitability of the material to rapid processing. Results are shown in Table 11.

<Steps>

| step | processing | temperature (0° C.) | processing time (sec) | replenished amount (mL based on 35 × 30.48 m) |
|---|---|---|---|---|
| 3. | developing | 39.5 ± 0.1 | 90 | 690 |

<Prescription of processing solution>

| | | | |
|---|---|---|---|
| developing | EDTA-2Na | 4.2 g | 5.9 g |
| | sodium sulfite | 3.9 g | 4.05 g |
| | 2-Na salt of 4,5-dihydroxybenene -1,3-disulfonic acid | 0.2 g | 0.41 g |
| | CD-2 | 3.20 g | 6.51 g |
| | sodium carbonate | 18.1 g | 19.0 g |
| | sodium bromide | 0.20 g | 0.18 g |
| | sodium hydroxide | — | 0.6 g |
| | sulfuric acid (7N) | 0.39 mL | — |

TABLE 5

Details of the samples used in Example 3 and assessment results

| Sample Number | Dispersion of Solid Particles of a Dye Kind | Content | Yellow Coupler | Weight Ratio Between the Oil-Soluble Component and the Hydrophilic Colloid in the 2nd Layer | Density Developed Color | Hue | Cyan Density in Unexposed Portions | Remarks |
|---|---|---|---|---|---|---|---|---|
| 201 | A | 16 | ExY | 0.68 | 1.00 | 0.17 | 0.08 | Comparative example |
| 202 | A | 16 | Comparative coupler 1 | 0.68 | 1.02 | 0.18 | 0.08 | Comparative example |
| 203 | A | 16 | Comparative coupler 2 | 0.65 | 0.82 | 0.15 | 0.08 | Comparative example |
| 204 | B | 16 | Comparative coupler 1 | 0.68 | 1.00 | 0.23 | 0.16 | Comparative example |
| 205 | D | 16 | Comparative coupler 1 | 0.68 | 1.02 | 0.16 | 0.08 | Comparative example |
| 206 | D | 16 | Comparative coupler 1 | 0.74 | 1.02 | 0.17 | 0.08 | Comparative example |
| 207 | D | 16 | Comparative coupler 1 | 0.78 | 1.03 | 0.17 | 0.08 | Comparative example |
| 208 | D | 16 | Comparative coupler 2 | 0.65 | 0.83 | 0.14 | 0.07 | Comparative example |
| 209 | A | 16 | (1) | 0.74 | 1.04 | 0.16 | 0.08 | Present example |
| 210 | B | 16 | (1) | 0.74 | 1.03 | 0.22 | 0.17 | Comparative example |

TABLE 5-continued

Details of the samples used in Example 3 and assessment results

| Sample | Dispersion of Solid Particles of a Dye | | | Weight Ratio Between the Oil-Soluble Component and the | Density Developed | | Cyan Density in Unexposed | |
|---|---|---|---|---|---|---|---|---|
| Number | Kind | Content | Yellow Coupler | Hydrophilic Colloid in the 2nd Layer | Color | Hue | Portions | Remarks |
| 211 | C | 16 | (1) | 0.74 | 1.03 | 0.21 | 0.14 | Comparative example |
| 212 | D | 16 | (1) | 0.74 | 1.05 | 0.15 | 0.07 | Present example |
| 213 | E | 16 | (1) | 0.74 | 1.05 | 0.15 | 0.07 | Present example |
| 214 | F | 16 | (1) | 0.74 | 1.06 | 0.15 | 0.09 | Present example |
| 215 | G | 16 | (1) | 0.74 | 1.04 | 0.15 | 0.08 | Present example |
| 216 | H | 16 | (1) | 0.74 | 1.05 | 0.15 | 0.08 | Present example |
| 217 | I | 16 | (1) | 0.74 | 1.03 | 0.15 | 0.09 | Present example |
| 218 | D | 16 | (1) | 0.68 | 1.05 | 0.15 | 0.08 | Present example |
| 219 | D | 16 | (1) | 0.78 | 1.05 | 0.15 | 0.08 | Comparative example |
| 220 | D | 30 | (1) | 0.74 | 1.04 | 0.15 | 0.07 | Present example |
| 221 | D | 40 | (1) | 0.74 | 1.04 | 0.14 | 0.07 | Present example |
| 222 | D | 16 | (3) | 0.68 | 1.03 | 0.15 | 0.07 | Present example |
| 223 | D | 16 | (32) | 0.71 | 1.05 | 0.13 | 0.07 | Present example |
| 224 | G | 16 | (3) | 0.68 | 1.03 | 0.15 | 0.08 | Present example |
| 225 | G | 16 | (32) | 0.71 | 1.04 | 0.13 | 0.08 | Present example |
| 226 | H | 16 | (3) | 0.68 | 1.04 | 0.15 | 0.08 | Present example |
| 227 | H | 16 | (32) | 0.71 | 1.04 | 0.13 | 0.07 | Present example |

From the assessment results, it is understood that the samples using the yellow coupler of the present invention can provide both the superior hue of the yellow images and high density of the developed color even in the rapid processing system described above. Further, it is understood that only the dispersion of solid particles of a dye used in the present invention can be decolorized without problem in the rapid processing system described above. Accordingly, only the samples of the present invention consisting of such combination are suitable for the rapid processing system described above. Although Sample 219 exhibits good results in Table 11, this sample cannot be said to be suitable for the rapid processing system, because as stated previously, the film strength of this sample is insufficient as shown in Example 1 and Example 2.

[Effects of the Invention]

The present invention solves the problems of prior art and can provide both the superior hue of the yellow images and high density of the developed color. Further, the present invention can provide a silver halide color photographic photosensitive material having high-quality images excellent in sharpness and film strength and can provide a silver halide color photographic photosensitive material for cinema having these properties in particular.

What is claimed is:

1. A silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein each of the yellow-developing photosensitive silver halide emulsion layer contains at least one dye-forming coupler represented by the following general formula (Y-1) , the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [I]:

General formula (Y-1)

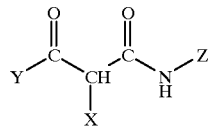

wherein Y represents a nitrogen-containing heterocycle; Z represents a substituted aryl group; X represents a hydrogen atom, or a group that leaves by the reaction with an oxidized form of a developing solution:

General formula (I)

$$D\text{-}(X)_y$$

wherein D represents a residue of a compound having a chromophoric group; X represents a dissociative hydrogen atom or a group having a dissociative hydrogen atom; and y is an integer of 1 to 7.

2. A silver halide color photographic photosensitive material according to claim 1, wherein the dispersion of solid particles of a dye represented by the general formula [I] is a dispersion that has undergone a heat treatment at or above 40° C.

3. A silver halide color photographic photosensitive material according to claim 2, wherein in the layer of the non-photosensitive hydrophilic colloid layer containing a dispersion of solid particles of a dye represented by the general formula [I], the content of the dye is 35 weight % or less relative to the hydrophilic colloid.

4. A silver halide color photographic photosensitive material according to claim 2, wherein the weight ratio of the weight of the components insoluble in water but soluble in an organic solvent to the dry weight of the hydrophilic colloid in the yellow-developing photosensitive silver halide emulsion layer is 0.70 or less.

5. A silver halide color photographic photosensitive material according to claim 1, wherein in the layer of the non-photosensitive hydrophilic colloid layer containing a dispersion of solid particles of a dye represented by the general formula [I], the content of the dye is 35 weight % or less relative to the hydrophilic colloid.

6. A silver halide color photographic photosensitive material according to claim 1, wherein the weight ratio of the weight of the components insoluble in water but soluble in an organic solvent to the dry weight of the hydrophilic colloid in the yellow-developing photosensitive silver halide emulsion layer is 0.70 or less.

7. A silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein each of the yellow-developing photosensitive silver halide emulsion layer contains at least one dye-forming coupler represented by the following general formula (Y-1) , the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [II]:

General formula (Y-1)

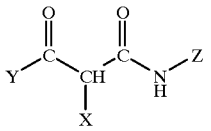

wherein Y represents a nitrogen-containing heterocycle; Z represents a substituted aryl group; X represents a hydrogen atom, or a group that leaves by the reaction with an oxidized form of a developing solution:

General formula (II)

$$A^1{=}L^1{-}(L^2{=}L^3)_m{-}Q$$

wherein $A^1$ represents an acidic nucleus, Q represents an aryl group or a heterocyclic group; $L^1$, $L^2$, and $L^3$ each represents a methine group; and m represents 0, 1, or 2, with the proviso that the dye represented by the general formula [II] described above has in the molecule thereof 1 to 7 carboxyl groups.

8. A silver halide color photographic photosensitive material according to claim 7, wherein the dispersion of solid particles of a dye represented by the general formula [I] is a dispersion that has undergone a heat treatment at or above 40° C.

9. A silver halide color photographic photosensitive material according to claim 8, wherein in the layer of the non-photosensitive hydrophilic colloid layer containing a dispersion of solid particles of a dye represented by the general formula [I], the content of the dye is 35 weight % or less relative to the hydrophilic colloid.

10. A silver halide color photographic photosensitive material according to claim 8, wherein the weight ratio of the weight of the components insoluble in water but soluble in an organic solvent to the dry weight of the hydrophilic colloid in the yellow-developing photosensitive silver halide emulsion layer is 0.70 or less.

11. A silver halide color photographic photosensitive material according to claim 7, wherein in the layer of the non-photosensitive hydrophilic colloid layer containing a dispersion of solid particles of a dye represented by the general formula [I], the content of the dye is 35 weight % or less relative to the hydrophilic colloid.

12. A silver halide color photographic photosensitive material according to claim 11, wherein the weight ratio of the weight of the components insoluble in water but soluble in an organic solvent to the dry weight of the hydrophilic colloid in the yellow-developing photosensitive silver halide emulsion layer is 0.70 or less.

13. A silver halide color photographic photosensitive material according to claim 7, wherein the weight ratio of the weight of the components insoluble in water but soluble in an organic solvent to the dry weight of the hydrophilic colloid in the yellow-developing photosensitive silver halide emulsion layer is 0.70 or less.

14. A silver halide color photographic photosensitive material comprising a support having thereon at least one yellow-developing photosensitive silver halide emulsion layer, at least one cyan-developing photosensitive silver halide emulsion layer, at least one magenta-developing photosensitive silver halide emulsion layer, and at least one non-photosensitive hydrophilic colloid layer, wherein each of the yellow-developing photosensitive silver halide emulsion layer contains at least one dye-forming coupler represented by the following general formula (Y-1), the weight ratio of the weight of the components insoluble in water but soluble in an organic solvent to the dry weight of the hydrophilic colloid in the yellow-developing photosensitive silver halide emulsion layer is 0.75 or less, and at least one layer of the non-photosensitive hydrophilic colloid layers contains a dispersion of solid particles of a dye represented by the following general formula [III].

General formula (Y-1)

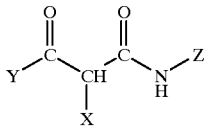

wherein Y represents a nitrogen-containing heterocycle; Z represents a substituted aryl group; X represents a hydrogen atom, or a group that leaves by the reaction with an oxidized form of a developing solution, General formula (III)

$$A^1{=}L^1{-}(L^2{=}L^3)_n{-}A^2$$

wherein $A^1$ and $A^2$ each represents an acidic nucleus; $L^1$, $L^2$, and $L^3$ each represents a methine group; and n represents 1, or 2, with the proviso that the dye represented by the general formula [III] described above has in the molecule thereof 1 to 7 carboxyl groups.

15. A silver halide color photographic photosensitive material according to claim 14, wherein the dispersion of solid particles of a dye is a dispersion that has undergone a heat treatment at or above 40° C.

16. A silver halide color photographic photosensitive material according to claim 15, wherein in the layer of the non-photosensitive hydrophilic colloid layer containing a dispersion of solid particles of a dye represented by the general formula [I], the content of the dye is 35 weight % or less relative to the hydrophilic colloid.

17. A silver halide color photographic photosensitive material according to claim 15, wherein the weight ratio of the weight of the components insoluble in water but soluble in an organic solvent to the dry weight of the hydrophilic colloid in the yellow-developing photosensitive silver halide emulsion layer is 0.70 or less.

18. A silver halide color photographic photosensitive material according to claim 14, wherein in the layer of the non-photosensitive hydrophilic colloid layer containing a dispersion of solid particles of a dye represented by the general formula [I], the content of the dye is 35 weight % or less relative to the hydrophilic colloid.

19. A silver halide color photographic photosensitive material according to claim 18, wherein the weight ratio of the weight of the components insoluble in water but soluble in an organic solvent to the dry weight of the hydrophilic colloid in the yellow-developing photosensitive silver halide emulsion layer is 0.70 or less.

20. A silver halide color photographic photosensitive material according to claim 14, wherein the weight ratio of the weight of the components insoluble in water but soluble in an organic solvent to the dry weight of the hydrophilic colloid in the yellow-developing photosensitive silver halide emulsion layer is 0.70 or less.

21. A silver halide color photographic photosensitive material according to claim 1, wherein the silver halide color photographic photosensitive material is a silver halide color photographic photosensitive material for cinema.

22. A silver halide color photographic photosensitive material according to claim 7, wherein the silver halide color photographic photosensitive material is a silver halide color photographic photosensitive material for cinema.

23. A silver halide color photographic photosensitive material according to claim 14, wherein the silver halide color photographic photosensitive material is a silver halide color photographic photosensitive material for cinema.

24. A silver halide color photographic photosensitive material according to claim 1, wherein Y of the General formula (Y-1) represents a nitrogen-containing heterocycle that does not contain a nitrogen at its terminal directly connected to the carbonyl group of the General formula (Y-1).

25. A silver halide color photographic photosensitive material according to claim 7, wherein Y of the General formula (Y-1) represents a nitrogen-containing heterocycle that does not contain a nitrogen at its terminal directly connected to the carbonyl group of the General formula (Y-1).

26. A silver halide color photographic photosensitive material according to claim 14, wherein Y of the General formula (Y-1) represents a nitrogen-containing heterocycle that does not contain a nitrogen at its terminal directly connected to the carbonyl group of the General formula (Y-1).

27. A silver halide color photographic photosensitive material according to claim 1, wherein the silver halide color photographic photosensitive material is a rapid processing silver halide color photographic photosensitive material for cinema that can be developed in a color development time of 2 minutes and 30 seconds or less.

28. A silver halide color photographic photosensitive material according to claim 7, wherein the silver halide color photographic photosensitive material is a rapid processing silver halide color photographic photosensitive material for cinema that can be developed in a color development time of 2 minutes and 30 seconds or less.

29. A silver halide color photographic photosensitive material according to claim 14, wherein the silver halide color photographic photosensitive material is a rapid processing silver halide color photographic photosensitive material for cinema that can be developed in a color development time of 2 minutes and 30 seconds or less.

30. A silver halide color photographic photosensitive material according to claim 1, wherein Y of the General formula (Y-1) is at least one selected from the group consisting of a 2-pyrrolyl group, 3-pyrrolyl, a 2-benzimidazolyl group, a 3-indazolyl group, a 3-pyrazolyl group, a 4-pyrazolyl group, a 5-pyrazolyl group, a 2-indolyl group, a 3-indolyl group,

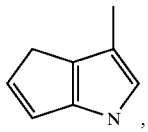

, and
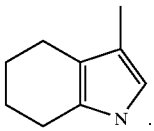

.

31. A silver halide color photographic photosensitive material according to claim 7, wherein Y of the General formula (Y-1) is at least one selected from the group consisting of a 2-pyrrolyl group, 3-pyrrolyl, a 2-benzimidazolyl group, a 3-indazolyl group, a 3-pyrazolyl group, a 4-pyrazolyl group, a 5-pyrazolyl group, a 2-indolyl group, a 3-indolyl group,

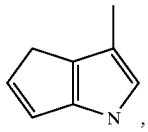

, and
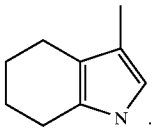

.

32. A silver halide color photographic photosensitive material according to claim 14, wherein Y of the General formula (Y-1) is at least one selected from the group consisting of a 2-pyrrolyl group, 3-pyrrolyl, a 2-benzimidazolyl group, a 3-indazolyl group, a 3-pyrazolyl group, a 4-pyrazolyl group, a 5-pyrazolyl group, a 2-indolyl group, a 3-indolyl group,

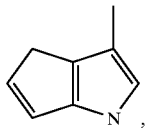

, and
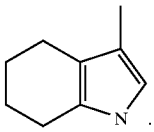

.

* * * * *